US006580889B1

(12) United States Patent
Ishiyama et al.

(10) Patent No.: US 6,580,889 B1
(45) **Date of Patent: *Jun. 17, 2003**

(54) IMAGE FORMING APPARATUS HAVING A MEMBER TO BE CHARGED, INJECTION CHARGING MEANS HAVING AN ELASTIC MEMBER FOR PRESS-CONTACTING THE MEMBER TO BE CHARGED, AND ELECTROCONDUCTIVE PARTICLES BETWEEN THE ELASTIC MEMBER AND THE MEMBER TO BE CHARGED

(75) Inventors: Harumi Ishiyama, Numazu (JP); Yukio Nagase, Shizuoka-ken (JP); Yasunori Chigono, Susono (JP); Jun Hirabayashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/634,330

(22) Filed: Aug. 7, 2000

Related U.S. Application Data

(62) Division of application No. 09/035,109, filed on Mar. 5, 1998, now Pat. No. 6,134,407.

(30) Foreign Application Priority Data

Mar. 5, 1997 (JP) ..... 9-067425
Mar. 5, 1997 (JP) ..... 9-067428

(51) Int. Cl.[7] ..... G03G 15/02
(52) U.S. Cl. ..... 399/174; 399/176
(58) Field of Search ..... 399/174, 175, 399/176, 313; 361/225; 430/902

(56) References Cited

U.S. PATENT DOCUMENTS

| | | | | |
|---|---|---|---|---|
| 4,706,320 A | | 11/1987 | Swift | 15/1.51 |
| 5,241,342 A | | 8/1993 | Asano et al. | 399/175 |
| 5,432,037 A | | 7/1995 | Nishikiori et al. | 430/126 |
| 5,532,795 A | | 7/1996 | Tatsumi et al. | 355/210 |
| 5,579,095 A | | 11/1996 | Yano et al. | 355/219 |
| 5,602,712 A | * | 2/1997 | Daifuku et al. | 361/222 |
| 5,606,401 A | | 2/1997 | Yano | 355/219 |
| 5,754,926 A | | 5/1998 | Sakuraba et al. | 399/175 |
| 5,754,927 A | | 5/1998 | Ishiyama et al. | 399/176 |
| 6,081,681 A | | 6/2000 | Nagase et al. | 399/174 |
| 6,128,456 A | * | 10/2000 | Chigono et al. | 399/176 |
| 6,134,407 A | * | 10/2000 | Ishiyama et al. | 399/174 |

FOREIGN PATENT DOCUMENTS

| | | | |
|---|---|---|---|
| EP | 0690352 A | | 1/1996 |
| EP | 0747780 A | | 12/1996 |
| JP | 63-149699 | | 6/1988 |
| JP | 3-103878 | | 4/1991 |
| JP | 5-150539 | | 6/1993 |
| JP | 5-241423 | | 9/1993 |
| JP | 6-11948 | | 1/1994 |
| JP | 6003921 | | 1/1994 |
| JP | 6-75459 | * | 3/1994 |
| JP | 6-250566 | | 9/1994 |
| JP | 7-5748 | | 1/1995 |
| JP | 7-152222 | | 6/1995 |
| JP | 7-234571 | | 9/1995 |
| JP | 8-62932 | * | 3/1996 |
| JP | 9-15935 | | 1/1997 |
| JP | 9-50161 | * | 2/1997 |
| JP | 9-190046 | | 7/1997 |

* cited by examiner

*Primary Examiner*—Joan Pendegrass
(74) *Attorney, Agent, or Firm*—Fitzpatrick, Cella, Harper & Scinto

(57) ABSTRACT

A charging apparatus includes a charging member, to which a voltage is applicable, for charging a member to be charged; the charging member including: a flexible member for forming a nip with the member to be charged, wherein the flexible member is moved with a peripheral speed difference between surfaces of the flexible member and the member to be charged at the nip; and electroconductive particles in the nip.

18 Claims, 6 Drawing Sheets

IMAGE FORMING APPARATUS HAVING A MEMBER TO BE CHARGED, INJECTION CHARGING MEANS HAVING AN ELASTIC MEMBER FOR PRESS-CONTACTING THE MEMBER TO BE CHARGED, AND ELECTROCONDUCTIVE PARTICLES BETWEEN THE ELASTIC MEMBER AND THE MEMBER TO BE CHARGED

This is a Divisional Application of U.S. patent application Ser. No. 09/035,109, filed Mar. 5, 1998 now U.S. Pat. No. 6,134,407.

FIELD OF THE INVENTION AND RELATED ART

The present invention relates to a charging apparatus and a charging method, which use electrically conductive particles to charge an object, such as an image bearing member. It also relates to a process cartridge and an image forming apparatus, which are compatible with such a charging apparatus and a charging method.

Prior to the present invention, a corona type charger (corona discharging device) has been widely used as a charging apparatus for charging (inclusive of discharging) an image bearing member (object to be charged) such as an electrophotographic photosensitive member or an electrostatic dielectric recording member to a predetermined polarity and a predetermined potential level in an image forming apparatus, for example, an electrophotographic apparatus (copying machine, printer, or the like) or an electrostatic recording apparatus.

The corona-type charging device is a noncontact-type charging device, and comprises a corona discharging electrode, such as a wire electrode, and a shield electrode which surrounds the corona discharging electrode. It is disposed so that the corona discharging opening thereof faces an image bearing member, that is, an object to be charged. In usage, the surface of an image bearing member is charged to a predetermined potential level by being exposed to discharge current (corona shower) generated as high voltage which is applied between the corona. discharging electrode and the shield electrode.

In recent years, it has been proposed to employ a contact-type charging apparatus as a charging apparatus for charging the image bearing member, that is, the object to be charged, in an image forming apparatus of low to medium speed. This is due to the fact that a contact-type charging apparatus has an advantage over a corona-type charging apparatus in terms of low ozone production, low power consumption, or the like. Also, such a contact-type charging apparatus has been put to practical use.

In order to charge an object, such as an image bearing member, with the use of a contact-type charging apparatus, the electrically conductive charging member contact-type charging member, contact-type charging device, or the like) of a contact-type apparatus is placed in contact with the object to be charged, and an electrical bias (charge bias) of a predetermined level is applied to this contact-type charging member so that the surface of the object to be charged is charged to a predetermined polarity and a predetermined potential level. The charging member is available in various forms, for example, a roller-type member (charge roller), a fur-brush-type member, a magnetic-brush type member, a blade-type member, and the like.

In reality, when an object is electrically charged by a contact-type charging member, two types of charging mechanisms (charging mechanism or charging principle: (1) mechanism which discharges electrical charge, and (2) mechanism for injecting charge) come into action. Thus, the characteristics of each contact-type charging apparatuses or methods are determined by the charging mechanism which is the dominant one of the two in charging the object.

(1) Electrical Discharge Based Charging Mechanism

This charging mechanism is a charging mechanism in which the surface of an object to be charged is charged by electrical discharge, which occurs across a microscopic gap between a contact-type charging member and the object to be charged.

In the case of the electrical-discharge-based charging mechanism, there is a threshold voltage which must be surpassed by the charge bias applied to a contact-type charging member before electrical discharge occurs between a contact-type charging member and an object to be charged, and therefore, in order for an object to be charged through the electrical discharge based charging mechanism, it is necessary to apply to the contact-type charging member a voltage with a value greater than the value of the potential level to which the object is to be charged. Thus, in principle, when the electrical discharge based charging mechanism is in action, it is impossible to avoid generating by-products of electrical discharge, that is, active ions, such as ozone ions. In reality, even a contact-type charging apparatus charges an object partially through the electrical-charge discharging mechanism as described above, and therefore, a contact-type charging apparatus cannot completely eliminate the problems caused by the active ions such as ionized ozone.

(2) Direct-charge Injection Mechanism

This is a mechanism in which the surface of an object to be charged is charged as electrical charge is directly injected into the object to be charged, with the use of a contact-type charging member. Thus, this mechanism is called "direct charging mechanism", or "charge injection mechanism". More specifically, a contact-type charging member with medium electrical resistance is placed in contact with the surface of an object to be charged to directly inject electrical charge into the surface portion of an object to be charged, without relying on electrical. discharge, in other words, without using electrical discharge in principle. Therefore, even if the value of the voltage applied to contact-type charging member is below the discharge starting voltage value, the object to be charged can be charged to a voltage level which is substantially the same as the level of the voltage applied to the contact-type charging member.

This direct injection charging mechanism does not suffer from the problems caused by the by-product of electrical discharge since it is not accompanied by ozone production. However, in the case of this charging mechanism, the state of the contact between a contact-type charging member and an object to be charged greatly affects the manner in which the object is charged, since this charging mechanism is such a mechanism that directly charges an object. Thus, this direct injection charging mechanism should comprise a contact-type charging member composed of high density material, and also should be given a structure which provides a large speed difference between the charging member and the object to be charged, so that a given point on the surface of the object to be charged makes contact with a larger area of the charging member.

A) Charging Apparatus with Charge Roller

In the case of a contact-type charging apparatus, a roller-charge system, that is, a charging system which employs an electrically conductive roller (charge roller) as a contact-type charging member, is widely used because of its desirability in terms of safety.

As for the charging mechanism in this roller charge system, the aforementioned (1) charging mechanism, which discharges electrical charge, is dominant.

Charge rollers are formed of rubber or foamed material with substantial electrical conductivity, or electrical resistance of a medium level. In some charge rollers, the rubber or foamed material is layered to obtain a specific characteristic.

In order to maintain stable contact between a charge roller and an object to be charged (hereinafter, "photosensitive member"), a charge roller is given elasticity, which in turn increases the frictional resistance between the charge roller and the photosensitive member. Also in many cases, a charge roller is rotated by the rotation of a photosensitive drum, or is individually driven at a speed slightly different from that of the photosensitive drum. As a result, problems occur: absolute charging performance declines, the state of the contact between the charge roller and the photosensitive drum becomes less desirable, and foreign matter adheres to the charge roller and/or the photosensitive member. Prior to the present invention, the dominant charging mechanism through which a roller charging member charged an object was a charging mechanism which discharged electrical charge, and therefore, even with the use of a contact-type charging apparatus, it was impossible to completely prevent the nonuniform charging of the photosensitive member.

FIG. 5 is a graph which shows an example of efficiency in contact-type charging. In the graph, the abscissas represents the bias applied to a contact-type charging member, and the ordinate represents the potential levels corresponding to the voltage values of the bias applied to the contact-type charging member. The characteristics of the charging by a roller are represented by a line designated by a character A. According to this line, when a charge roller is used to charge an object, the charging of an object occurs in a voltage range above an electric discharge threshold value of approximately −500 V. Therefore, generally, in order to charge an object to a potential level of −500 V with the use of a charge roller, either a DC voltage of −1,000 V is applied to the charge roller, or an AC voltage with a peak-to-peak voltage of 1,200 V, in addition to a DC voltage of −500 V, is applied to the charge roller to keep the difference in potential level between the charge roller and the object to be charged, at a value greater than the electric-discharge threshold value, so that the potential of the photosensitive drum converges to the desired potential level.

More specifically, in order to charge a photosensitive drum with a 25 $\mu$m thick organic photoconductor layer by pressing a charge roller upon the photosensitive member, charge bias with a voltage value of approximately 640 V or higher should be applied to the charge roller. Where the value of the charge bias is approximately 640 V or higher, the potential level at the surface of the photosensitive member is proportional to the level of the voltage applied to the charge roller; the relationship between the potential level and the voltage applied to the charge roller is linear. This threshold voltage is defined as a charge start voltage $V_{th}$.

In other words, in order to charge the surface of a photosensitive member to a potential level of $V_d$ which is necessary for electrophotography, a DC voltage of $(V_d+V_{th})$, which is higher than the voltage level to which the photosensitive member is to be charged, is necessary. Hereinafter, the above described charging method in which only DC voltage is applied to a contact-type charging member to charge an object will be called a "DC charging method".

However, prior to the present invention, even with the use of the DC charging method, it was difficult to bring the potential level of a photosensitive member exactly to a target level, since the resistance value of a contact-charging member changed due to changes in ambience or the like, and also the threshold voltage $V_{th}$ changed as the photosensitive member was shaved away.

As for a counter measure for the above described problem, Japanese Laid-Open Patent Application No. 149,669/1988 discloses an invention which deals with the above problem to effect more uniform charging of a photosensitive member. According to this invention, an "AC charging method" is employed, in which a compound voltage composed of a DC component equivalent to a desired potential level $V_d$, and an AC component with a peak-to-peak voltage which is twice the threshold voltage $V_{th}$, is applied to a contact-type charging member. This invention is intended to utilize the averaging effect of alternating current. According to this invention, the potential of an object to be charged is caused to converge to the $V_d$, that is, the center of the peaks of the AC voltage, without being affected by external factors, such as operational ambience.

However, even in the case of the contact-type charging apparatus in the above described invention, the principal charging mechanism is a charging mechanism which uses electrical discharge from a contact-type charging member to a photosensitive. member. Therefore, as already described, the voltage applied to the contact-type charging member needs to have a voltage level higher than the voltage level to which the photosensitive member is to be charged. Thus, ozone is generated, although only in a small amount.

Further, when AC current is used so that an object is uniformly charged due to the averaging effect of AC current, the problems related to AC voltage become more conspicuous. For example, more ozone is generated; noises traceable to the vibration of the contact-type charging member and the photosensitive drum caused by the electric field of AC voltage increase; and the deterioration of the photosensitive member surface caused by electrical discharge increases, which add to the prior problems.

B) Charging Apparatus with Fur Brush

In the case of this charging apparatus, a charging member (fur-brush-type charging device) with a brush portion composed of electrically conductive fiber is employed as the contact-type charging member. The brush portion composed of electrically conductive fiber is placed in contact with a photosensitive member as an object to be charged, and a predetermined charge bias is applied to the charging member to charge the peripheral surface of the photosensitive member to a predetermined polarity and a predetermined potential level.

Also in the case of this charging apparatus with a fur brush, the dominant charging mechanism is the electrical-discharge based charging mechanism.

It is known that there are two type of fur-brush-type charging devices: a fixed type and a roller type. In the case of the fixed type, fiber with medium electrical resistance is woven into foundation cloth to form pile, and a piece of this pile is adhered to an electrode. In the case of the rotatable type, the pile is wrapped around a metallic core. In terms of fiber density, pile with a density of 100 fiber/cm$^2$ can be relatively easily obtained, but the density of 100 fiber/cm$^2$ is not sufficient to create a state of contact which is satisfactory to charge an object by charge injection. Further, in order to give a photosensitive member satisfactorily uniform charge by charge injection, a velocity difference which is almost impossible to attain with the use of a mechanical structure must be established between a photosensitive drum and a roller type fur brush. Therefore, the fur-brush-type charging device is not practical.

The relationship between the DC voltage applied to a fur-brush-type charging member and the potential level to which a photosensitive member is charged by the DC voltage applied to the fur brush shows a characteristic represented by a line B in FIG. 5. As is evident from the graph, also in the case of the contact-type charging apparatus which comprises a fur brush, whether the fur brush is of the fixed type or the roller type, the photosensitive member is charged mainly through electrical discharge triggered by applying to the fur brush a charge bias the voltage level of which is higher than the potential level desired for the photosensitive member.

C) Magnetic-Brush-type Charging Apparatus

A charging apparatus of this type comprises a magnetic brush portion (magnetic brush based charging device) as the contact-type charging member. A magnetic brush is constituted of electrically conductive magnetic particles magnetically confined in the form of a brush by a magnetic roller or the like. This magnetic brush portion is placed in contact with a photosensitive member as an object to be charged, and a predetermined charge bias is applied to the magnetic brush to charge the peripheral surface of the photosensitive member to a predetermined polarity and a predetermined potential level.

In the case of this magnetic brush type charging apparatus, the dominant charging mechanism is the charge injection mechanism (2).

As for the material for the magnetic brush portion, electrically conductive magnetic particles, the diameters of which are in a range of 5–50 $\mu$m, are used. With the provision of a sufficient difference in peripheral velocity between a photosensitive drum and a magnetic brush, the photosensitive member can be uniformly charged through charge injection.

In the case of a magnetic brush type charging apparatus, the photosensitive member is charged to a potential level which is substantially equal to the voltage level of the bias applied to the contact-type charging member, as shown by a line C in FIG. 5.

However, a magnetic brush type charging apparatus also has its own problems. For example, it is complicated in structure. Also, the electrically conductive magnetic particles, which constitute the magnetic brush portion, become separated from the magnetic brush and adhere to a photosensitive member.

Japanese Patent Publication Application No. 3,921/1994 discloses a contact-type charging method, according to which a photosensitive member is charged by injecting electric charge into the charge injectable surface layer thereof, more specifically, into the traps or electrically conductive particles in the charge injectable surface layer. Since this method does not rely on electrical discharge, the voltage level necessary to charge the photosensitive member to a predetermined potential level is substantially the same as the potential level to which the photosensitive member is to be charged, and in addition, no ozone is generated. Further, since AC voltage is not applied, there is no noise traceable to the application of AC voltage. In other words, a magnetic-brush type charging system is an excellent charging system superior to the roller-type charging system in terms of ozone generation and power consumption, since it does not generate ozone, and uses far less power compared to the roller-type charging system.

D) Toner Recycling Process (Cleanerless System)

In a transfer type image forming apparatus, the toner which remains on the peripheral surface of a photosensitive member (image bearing member) after image transfer is removed by a cleaner (cleaning apparatus) and becomes waste toner. Not only for obvious reasons, but also for environmental protection, it is desirable that the waste toner is not produced. Thus, image forming apparatuses capable of recycling toner have been developed. In such an image forming apparatus, a cleaner is eliminated, and the toner which remains on the photosensitive member after image transfer is removed from the photosensitive drum by a developing apparatus; the residual toner on the photosensitive member is recovered by a developing apparatus at the same time as a latent image on the photosensitive drum is developed by the developing apparatus, and then is reused for development.

More specifically, the toner which remains on a photosensitive member after image transfer is recovered by fog removal bias (voltage level difference $V_{back}$ between the level of the DC voltage applied to a developing apparatus and the level of the surface potential of a photosensitive member) during the following image transfer. According to this cleaning method, the residual toner is recovered by the developing apparatus and is used for the following image development and thereafter; the waste toner is eliminated. Therefore, the labour spent for maintenance is reduced. Further, being cleanerless is quite advantageous in terms of space, allowing image forming apparatuses to be substantially reduced in size.

E) Coating of Contact-type Charging Member with Electrically Conductive Powder

Japanese Laid-Open Patent Application No. 103,878/1991 discloses a contact-type charging apparatus with such a structure that coats a contact-type charging member with electrically conductive powder, on the surface which comes in contact with the surface of an object to be charged, so that the surface of the object to be charged is uniformly charged, that is, without irregularity in charge. The contact-type charging member in this charging apparatus is rotated by the rotation of the object to be charged, and the amount of ozone generated by this charging apparatus is remarkably small compared to the amount of ozonic products generated by a corona type charging apparatus such as SUKOROTRON. However, even in the case of this charging apparatus, the principle, based on which an object is charged, is the same as the principle, based on which an object is charged by the aforementioned charge roller; in other words, an object is charged by electrical discharge. Further, also in the case of this charging apparatus, in order to assure that an object to be charged is uniformly charged, compound voltage composed of DC component and AC component is applied to the contact-type charging member, and therefore, the amount of ozonic products traceable to electrical discharge becomes relatively large. Thus, even this contact-type charging apparatus is liable to cause problems; for example, images are affected by ozonic products, appearing as if flowing, when this charging apparatus is used for an extended period of time, in particular, when this charging apparatus is used in a cleanerless image forming apparatus for an extended period of time.

As described in the preceding paragraphs regarding the technologies prior to the present invention, it is difficult to directly charge an object with the use of a contact-type charging apparatus with a simple structure which comprises a contact-type charging member, such as a charge roller or a fur brush. Also in the case of an image forming apparatus which employs such a charging apparatus, the photosensitive member is liable to be insufficiently charged, causing images to appear foggy (during reversal development, toner is adhered to the areas which are supposed to remain white), or the photosensitive member is liable to be nonuniformly charged, causing images to be appear irregular in terms of continuity.

In the case of the contact-type charging apparatus structured so that the contact-type charging member is coated with electrically conductive powder, on the surface which comes in contact with the surface of the object to be charged, so that the contact-type charging member is rotated by the rotation of the photosensitive member, and so that the photosensitive member is mainly charged by electrical discharges, ozonic products are liable to be accumulated, and; images are affected by the accumulated ozonic products, appearing as if flowing, when such a charging apparatus is used for an extended period of time, in particular, when such a charging apparatus is used in a cleanerless image forming apparatus for an extended period of time.

Further, in the case of the cleanerless image forming apparatus, there is the problem that the residual toner causes the photosensitive member to be unsatisfactorily charged in a charging portion.

Further, U.S. Pat. No. 5,432,037 discloses an invention in which electrically conductive particles are mixed into developer so that even if developer adheres to a charger roller, the charging operation is not interfered with. However, also in this case, a photosensitive member is primarily charged through electrical discharge, and therefore, there are problems similar to those described above.

SUMMARY OF THE INVENTION

Accordingly, a primary object of the present invention is to provide a charging apparatus and a charging method, which are capable of uniformly charging an object, with the use of only a simple charging member such as a charge roller, a fiber brush, or the like, and also remain reliable for a long period of time.

Another object of the present invention is to provide a charging apparatus and a charging method, in which the voltage applied to a charging member is reduced so that an object can be charged without generating ozone.

Another object of the present invention is to provide a charging apparatus and a charging method, in which charge is injected into an object from an inexpensive charging member.

Another object of the present invention is to provide a charging apparatus and a charging method, which do not create problems traceable to ozonic products.

Another object of the present invention is to provide a contact type charging apparatus and a charging method, which do not generate the charging noises.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Figure 1:
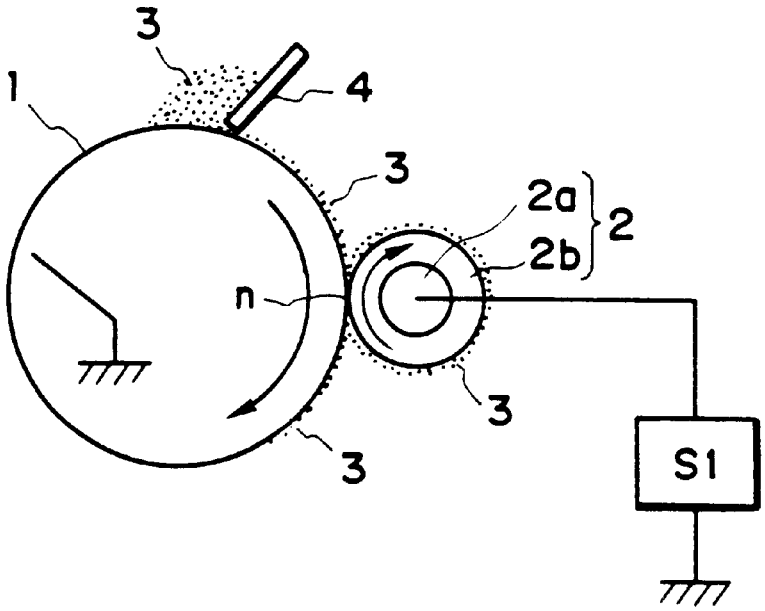
FIG. 1 is a schematic section of the contact-type charging apparatus in the first embodiment of the present invention, and depicts the general structure of the apparatus.

Embodiment 1 (FIG. 1)

FIG. 1 is a schematic section of an example of a contact-type charging apparatus in accordance with the present invention, and depicts the general structure of the apparatus.

Reference numeral 1 designates an object to be charged; reference numeral 2 denotes a contact-type charging member placed in contact with the object to be charged; reference numeral 3 denotes electrically conductive particle; and reference numeral 4 designates a means for supplying electrically conductive particles.

(1) Object to be Charged 1

In this embodiment, the object to be charged 1 is described as an electrophotographic photosensitive member. This photosensitive member 1 is cylindrical and comprises an organic photoconductor layer (negatively chargeable photosensitive member). It has a diameter of 30 mm, and is rotatively driven in the clockwise direction indicated by an arrow mark, at a constant peripheral velocity of 50 mm/sec.

(2) Contact-type Charging Member 2

In this embodiment, the contact-type charging member 2 is constituted of an electrically conductive elastic roller (hereinafter, "charge roller").

The charge roller 2 is constituted of a metallic core 2*a*, and a layer 2*b* of elastic material, such as rubber or foamed material, laid on the peripheral surface of the metallic core 2*a*. The elastic layer 2*b* has an intermediary resistance.

The intermediary resistance layer 2*b* is composed of resin (for example, urethane), electrically conductive particles (for example, carbon black), sulfurizing agent, foaming agent, etc., and is laid on the peripheral surface of the metallic core 2*a* to form a roller along with the metallic core 2. After being laid on the metallic core 2*a*, the surface of the medium resistance layer 2*b* is polished, if necessary, to obtain the charge roller 2, that is, an electrically conductive elastic roller measuring 12 mm in diameter and 250 mm in length.

The measured electrical resistance of the charge roller 2 in this embodiment was 100 kΩ. More specifically, the resistance of the charge roller 2 was measured in the following manner. The charge roller 2 was placed in contact with an aluminum drum with a diameter of 30 mm, so that the metallic core 2*a* of the charge roller 2 was subjected to an overall load of 1 kg, and then, the resistance of the charge roller 2 was measured while applying 100 V between the metallic core 2*a* and the aluminum drum.

In this embodiment, it is important that the charge roller 2, which is an electrically conductive elastic roller, functions as an electrode. In other words, the charge roller 2 must be able to create a desirable state of contact between the charge roller 2 and the object to be charged, and also its electrical resistance is desired to be sufficiently low to charge a moving object. On the other hand, it is desired to be able to prevent voltage from leaking through the defective portions, for example, pin holes, of an object to be charged, just in case such defects exist. Therefore, when the object to be charged is an electrophotographic photosensitive member, the electrical resistance of the charge roller 2 is desired to be in a range of $10^4$–$10^7$ Ω so that satisfactory charging performance and leak resistance is realized.

As for the hardness of the charge roller 2, if it is too low, the shape of the charge roller 2 becomes too unstable to maintain the desirable state of contact between the charge roller 2 and the object to be charged. If it is too high, the charge roller 2 fails to form a desirable charging nip between itself and the object to be charged, and also the state of contact between the charge roller 2 and the object to be charged, within the charging nip becomes inferior in terms of the microscopic level. Therefore, the desirable hardness range for the charge roller 2 is 25°–50° in ASKER-C scale.

The material for the charge roller 2 is not limited to the elastic foamed material described above. In addition to the material described above, it is possible to use EPDM, urethane, NBR, silicone rubber, IR, and the like, in which electrically conductive particles, such as carbon black or metallic oxide particles, have been dispersed, and the foamed version of the same materials. It should be noted here that the resistances of the materials may be adjusted with the use of ion conductive material, instead of dispersing the electrically conductive particles.

Figure 2:
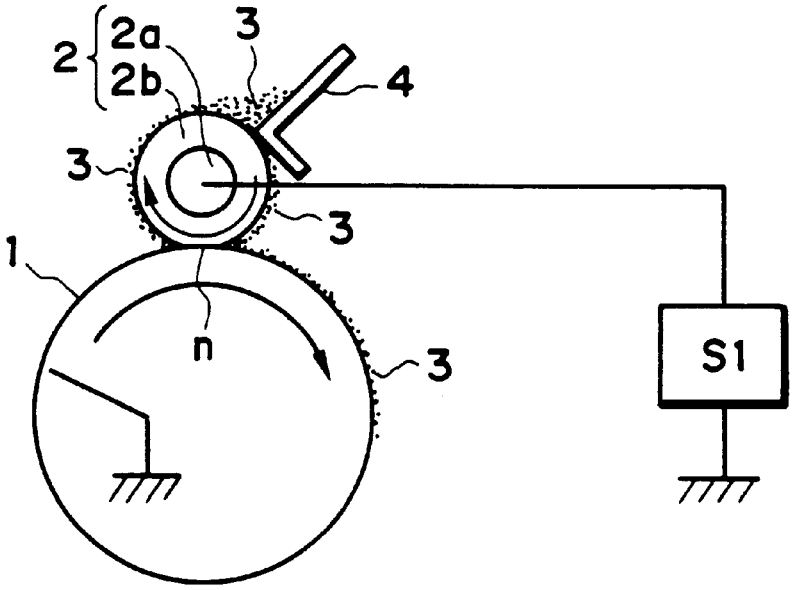
FIG. 2 is a schematic section of the contact-type charging apparatus in the second embodiment of the present invention, and depicts the general structure of the apparatus.

The charge roller 2 is placed in contact with the photosensitive member 1 as an object to be charged, being pressed against its own elasticity, with a predetermined contact pressure. In FIG. 2, a reference character n designates a contact nip between the photosensitive member 1 and the charge roller 2, that is, the charging nip. The width of this charging nip is 3 mm. In this embodiment, the charge roller 2 is rotatively driven in the clockwise direction indicated by an arrow mark at approximately 80 rpm, so that the peripheral surfaces of the charge roller 2 and the photosensitive member 1 move at the same velocity in the opposite directions in the charging nip n. In other words, the charge roller 2 and the photosensitive member 1 are driven so that there exists a peripheral velocity difference between the surface of the charge roller 2 as the contact-type charging member, and the surface of the photosensitive member 1 as the object to be charged.

To the metallic core 2*a* of the charge roller 2, a DC voltage of −700 V is applied as the charge bias from a charge bias application power source S1.

(3) Electrically Conductive Particles

The electrically conductive particles 3, which are in the nip between the charge roller 2 and the photosensitive member 1, are such particles that facilitate the charging process. Hereinafter, these particles are referred to as "charge facilitator particles". As for the material, the particle diameter, the characteristic features, or the like of the charge facilitator particle 3, the following are desirable.

In this embodiment, electrically conductive zinc oxide particles are used as the charge facilitator particles. The average particle diameter of the particles, inclusive of the secondary particles formed through adhesion of primary particles, is 3 μm, and their specific resistivity is $10^6$ Ω·cm.

As for the material for the charge facilitator particles 3, many other electrically conductive particles are usable; for example, metallic oxides other than the zinc oxide mentioned above, and mixture of electrically conductive particles and organic materials.

The specific resistance of the charge facilitator particles 3 is desired to be no more than $10^{12}$ Ω·cm, preferably, no more than $10^{10}$ Ω·cm, since electrical charge is given or received through the charge facilitator particles 3.

The specific resistance of the charge facilitator particles 3 is obtained using a tableting method. That is, first, a cylinder which measures 2.26 $cm^2$ in bottom area size is prepared. Then, 0.5 g of a material sample is placed in the cylinder, between the top and bottom electrodes, and the resistance of the material is measured by applying 100 V between the top and bottom electrodes while compacting the material between the top and bottom electrodes with a pressure of 15 kg. Thereafter, the specific resistivity of the sample material is calculated from the results of the measurement through normalization.

In order to uniformly charge an object, the average diameter of the charge facilitator particles 3 is desired to be no more than 50 μm. However, 10 nm is the bottom limit, in consideration of the stability of the charge facilitator particles 3.

When the charge facilitator particle 3 is in the form of a granule, the diameter of the granule is defined as the average diameter of charge facilitator granules.

The diameter of the charge facilitator granule is determined based on the following method. First, 100 or more granules are picked with the use of an optical or electron microscope, and their maximum chord lengths in the horizontal direction are measured. Then, volumetric particle distribution is calculated from the result of the measurement. Based on this distribution a, 50% average granule diameter is calculated to be used as the average granule diameter of the charge facilitator granules. It should be noted here that the charge facilitator particles are desired to be nonmagnetic.

As described above, the charge facilitator particles 3 are in the primary state, that is, a powdery state, as well as in the secondary state, that is, a granular state. Neither state creates a problem. Whether the charge facilitator is in the powdery state or in the granular state, the state of the charge facilitator does not matter as long as it can function as the charge facilitator.

(4) Means for Supplying Electrically Conductive Particles 4 (Means for Coating Charge Facilitator Particles)

In this embodiment, in order to place the charge facilitator particles 3 in the charging nip n, that is, the contact nip between the photosensitive member 1 as an object to be charged, and the charge roller 2 as a contact-type charging member, a means 4 for supplying the surface of the photosensitive member 1 with the charge facilitator particles 3 is disposed on the upstream side of the charging nip n, relative to the rotational direction of the photosensitive member 1.

The charge facilitator particle supplying means 4 in this embodiment is constituted of a regulator blade. This regulator blade 4 is placed in contact with the photosensitive member 1 so that the charge facilitator particles 3 are held in the space formed by the peripheral surface of the photosensitive member 1 and the regulator blade 4, and at the same time, the charge facilitator particles 3 held in this space are coated on the peripheral surface of the photosensitive member 1.

More specifically, as the photosensitive member 1 is rotated, the charge facilitator particles 3 are coated on the peripheral surface of the photosensitive member 1 at a predetermined ratio ($\mu g/mm^2$), and carried to the charging nip n. In other words, as the photosensitive member 1 is rotated, the charging nip n is supplied with the charge facilitator particles 3 at a predetermined constant ratio. Thus, a predetermined amount of the charge facilitator particles 3 is always in the charging nip n.

The charge roller 2 as a contact-type charging member is rotated so that there is a peripheral velocity difference between the charge roller 2 and the photosensitive member 1 as an object to be charged. Therefore, the charge roller 2 in this embodiment deforms in and adjacent to the charging nip n, that is, the contact nip between the charge roller 2 formed of elastic material, and the photosensitive member 1, much more than a charge roller which follows the rotation of a photosensitive member, being more liable to allow the charge facilitator particles 3, which are adhering to the peripheral surface of the charge roller 2, to transfer onto the photosensitive member 1. Thus, as the usage of the apparatus continues, the amount of the charge facilitator particles 3 on the peripheral surface of the charge roller 2 gradually decreases. This is the reason the charge facilitator particle supplying means 4 is constructed so that the charge facilitator particles 3 are coated on the peripheral surface of the photosensitive member 1 at a predetermined constant ratio, and are carried to the charging nip n, that is, the contact nip between the charge roller 2 and the photosensitive member 1.

If the amount of the charge facilitator particles 3 between the photosensitive member 1 and the charge roller 2 as a contact-type charging member, in the charging nip n, is extremely small, the lubricative effect from the charge facilitator particles 3 is not sufficient. As a result, the friction between the charge roller 2 and the photosensitive member 1 remains relatively large, which makes it hard for the charge roller 2 and the photosensitive member 1 to rotate while maintaining a peripheral velocity difference between them. In other words, it takes too much torque to drive them. In addition, if they are forcefully rotated against considerable friction, their peripheral surfaces are shaved. Further, the extremely small amount of the charge facilitator particles 3 fails to sufficiently improve the state of contact between the charge roller 2 and the photosensitive member 1, and therefore, the improvement in the charging performance of the apparatus is not sufficient. On the other hand, if the amount of the charge facilitator particles 3 between the charging roller 2 and the photosensitive member 1 is extremely large, too much charge facilitator particles 3 fall off from the charge roller 2, which sometimes has detrimental effects on image formation.

According to tests, the amount of the charge facilitator particles 3 between the charge roller, 2 and the photosensitive member 1 is desired to be no less than $10^3$ particle/mm$^2$. If it is less than $10^3$ particle/mm$^2$, the lubricative effect, and the improvement in the state of contact between the charge roller 2 and the photosensitive member 1, are not sufficient, and therefore, the improvement in the charging performance is not as much as expected.

The more desirable amount is in a range of $50^3$–$5\times10^5$ particle/mm$^2$. If the amount of charge facilitator particles 3 exceeds $5\times10^5$ particle/mm$^2$, the amount of the charge facilitator particles 3 which separate from the charge roller 2 and move to the photosensitive member 1 increases, preventing thereby the photosensitive member 1 from being insufficiently, exposed regardless of the transmittance of the charge facilitator particles 3 themselves. If it is below $5\times10^5$ particle/cm$^2$, the amount of the charge facilitator particles 3 which depart from the photosensitive member 1 becomes moderate, and therefore, the harmful effect of the charge facilitator particles 3 is minimized. When the amount of the charge facilitator particles 3 which transferred onto the photosensitive member 1 while keeping the amount of the charge facilitator particles 3 between the charge roller 2 and the photosensitive member 1 in the above mentioned more desirable range was measured, it was within a range of $10^2$–$10^5$ particle/cm$^2$, which proves that the desirable amount of the charge facilitator particles 3 placeable between the charge roller 2 and the photosensitive member 1 without harmfully affecting image formation is no more than $10^5$ particle/cm$^2$.

Next, the method used for measuring the amount of the charge facilitator particles 3 between the charge roller 2 and the photosensitive member 1, and the amount of the charge facilitator particles 3 on the photosensitive member 1, will be described. It is desirable that the amount of the charge facilitator particles 3 between the charge roller 2 and the photosensitive member 1 is directly measured in the charging nip n between the charge roller 2 and the photosensitive member 1. However, most of the charge facilitator particles 3 which are already on the photosensitive member 1 are stripped away by the charge roller 2 which rotates in contact with the photosensitive member 1, in the direction opposite to the rotational direction of the photosensitive member 1, and therefore, the amount of the charge facilitator particles on the charge roller 2 measured immediately before the charging nip n is substituted for the actual amount of the charge facilitator particles between the charge roller 2 and the photosensitive member 1. More specifically, the rotation of the photosensitive member 1 and charge roller 2 is stopped, and the peripheral surfaces of the photosensitive member 1 and the charge roller 2 are photographed by a video-microscope (product of Olympus: OVM1000N) and a digital still recorder (product of Deltis: SR-3100), without applying the charge bias. In photographing the peripheral surface of the charge roller 2, the charge roller 2 is pressed against a piece of slide glass under the same condition as the charge roller 2 is pressed against the photosensitive member 1, and no less than 10 spots in the contact area between the charge roller 2 and the slide glass were photographed with the use of the video-microscope fitted with an object lens with a magnification power of 1,000. The thus obtained digital images are digitally processed using a predetermined threshold. Then, the number of cells in which a particle is present is calculated with the use of a designated image processing software. As for the amount of the charge facilitator particles on the photosensitive member 1, the peripheral surface of the photosensitive member 1 is photographed using the same video-microscope, and then, the obtained images are processed in the same manner to obtain the number of the charge facilitator particles on the photosensitive member 1.

The amount of the charge facilitator articles between the charge roller 2 and the hotosensitive member 1 is adjusted by varying the setting of the regulator blade.

(5) Charging of Photosensitive Member 1

The photosensitive member 1 is charged with the presence of the charge facilitator particles 3 in the charging nip n, that is, between the peripheral surface of the charge roller 2 as a contact-type charging member, and the photosensitive member 1 as an object to be charged, as described in the foregoing.

Thus, the charge roller 2 is allowed to be desirably in contact with the photosensitive member 1 in electrical terms, through the charge facilitator particles 3, while maintaining a peripheral velocity difference between itself and the photosensitive member 1, in the charging nip n. In other words, the charge facilitator particles. 3 present in the charging nip n, that is, the contact nip between the charge roller 2 and the photosensitive member 1, rub the peripheral surface of the photosensitive member 1, leaving thereby no gap between the charge roller 2 and photosensitive member 1. Thus, charge is truly directly injected into the photosensitive member 1; the presence of the charge facilitator particles 3 renders the direct charge mechanism (charge injection) dominant in charging the photosensitive member 1 with the use of the charge roller 2.

Consequently, a high level of charging efficiency, which was impossible to attain prior to the present invention, can be attained; the photosensitive member 1 is charged to a potential level substantially equal to the level of the voltage applied to the charge roller 2. In this embodiment, the photosensitive member 1 is charged to a potential level of −680 V which is substantially equal to the DC voltage of −700 V applied to the charge roller 2.

As is evident from the above description, according to this first embodiment of the present invention, even if a charge roller with a relatively simple-structure is employed as a contact-type charging member, the voltage level of the charge bias applied to the charge roller 2 to charge the photosensitive member 1, as an object to be charged, to a necessary potential level has only to be equivalent to the necessary potential level for the photosensitive member 1, making it possible to realize a safe and reliable charging mechanism which does not rely on electrical discharge. In other words, it is possible to provide a durable contact-type charging apparatus, which employs, as a contact-type charging member, only a simple charging member, such as a charge roller, and yet is capable of uniformly charging an object, through a direct charging process, or the charge injection, which requires relatively low voltage, and does not generate ozone.

Embodiment 2 (FIG. 2)

FIG. 2 is a schematic section of another example of a contact-type charging apparatus in accordance with the present invention, and depicts the general structure of the apparatus.

This embodiment is similar to the contact-type charging apparatus described in the first embodiment, except that the charge facilitator particle supplying means 4 is disposed on the side of the charge roller 2 as a contact-type charging member, instead of being placed on the side of the photosensitive member 1 as an object to be charged. The other structural features of this contact-type charging apparatus are similar to those of the contact-type charging apparatus described in the first embodiment, and therefore, their descriptions will be omitted.

Also in this embodiment, the charge facilitator particle supplying means 4 is constituted of a regulator blade. The regulator blade 4 is placed in contact with the charge roller 2 so that the charge facilitator particles 3 are held in the space formed by the charge roller 2 and the regulator blade 4.

As the charge roller 2 is rotated, the charge facilitator particles 3 are coated on the peripheral surface of the charge roller 2 at a predetermined ratio ($\mu g/cm^2$), and then are carried to the charging nip n; the charging nip n is supplied with the charge facilitator particles 3 at a predetermined ratio, so that they are always present between the charging nip n Also in this embodiment, the presence of the charge facilitator particles 3 in the charging nip n renders the direct charging mechanism (charge injection) dominant in charging the photosensitive member 1 by the charge roller 2, as it is in the first embodiment.

A structure similar to the structure in this embodiment, in which the charge facilitator particle supplying means 4 is disposed on the side of the charge roller 2 as a contact-type charging member, is effective to reduce the apparatus size, since the charge facilitator particles 3 can be coated without increasing the number of components to be disposed around the photosensitive member 1 as an object to be charged.

Figure 3:
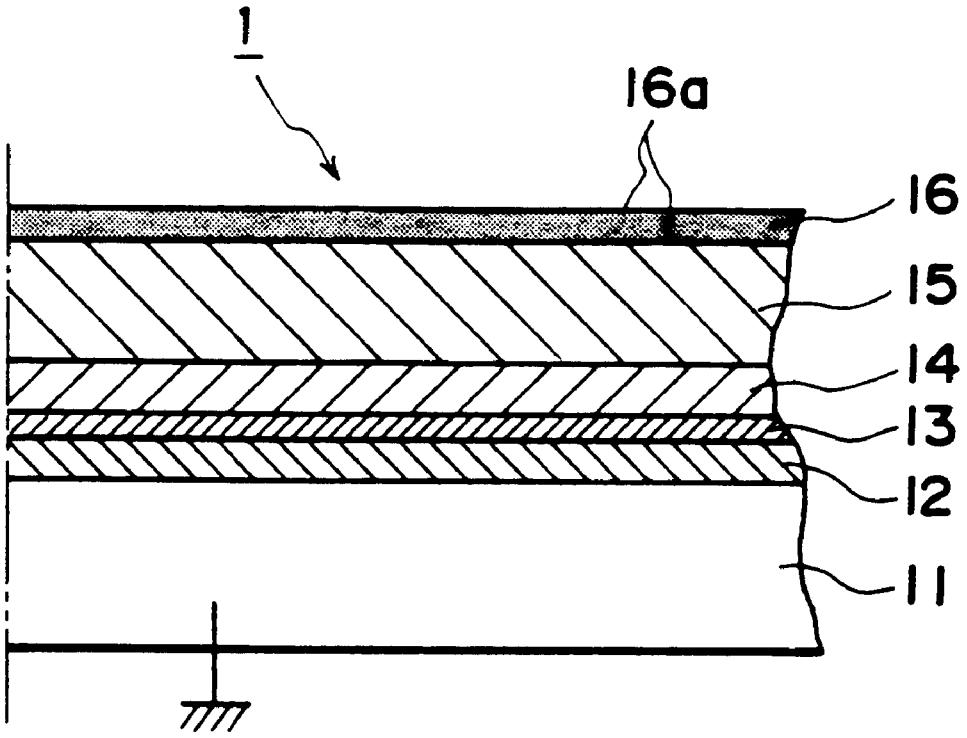
FIG. 3 is a schematic section of the surface portion of the photosensitive member in the third embodiment of the present invention, and depicts the laminar structure which has a charge injection layer as the outermost layer.

Embodiment 3 (FIG. 3)

This embodiment is similar to the first or second embodiment, except that the surface resistance of the photosensitive member 1, or an object to be charged, is adjusted so that the photosensitive member 1 is more uniformly and reliably charged. More specifically, the peripheral surface of the photosensitive member 1 as an object to be charged is covered with a charge injection layer to adjust the surface resistance of the photosensitive member 1, so that the photosensitive member 1 is more uniformly and reliably charged.

FIG. 3 is an enlarged schematic section of a portion of the photosensitive member 1 provided with the charge injection layer employed in this embodiment, and depicts the laminar structure of the photosensitive member 1. In this embodiment, the photosensitive member 1 is formed by coating a charge injection layer 16 on the peripheral surface of an ordinary photosensitive member, which is constituted of an aluminum drum 11 (base member), and various layers: an undercoat layer 12, a positive charge injection prevention layer 13, a charge generation layer 14, and a charge transfer layer 15, which are coated on the aluminum drum 11 in this order from the bottom. The charge injection layer 16 is coated to improve the photosensitive member 1 in terms of chargeability.

The charge injection layer 16 is composed of binder, electrically conductive particles 16*a* (electrically conductive filler), lubricant, polymerization initiator, and the like. The binder is photocurable acrylic resin, and the electrically conductive particles 16*a* are ultramicroscopic particles of $SnO_2$ (0.03 $\mu$m in diameter). The lubricant is tetrafluoroethylene (Teflon). The filler, lubricant, polymerization initiator, and the like are mixedly dispersed in the binder. Then, the mixture is coated on an ordinary photosensitive member, and is photocured.

The most important property of the charge injection layer 16 is its electrical resistance. In the case of a method for charging an object by. directly injecting charge into the object, the efficiency with which an object is charged is improved by reducing the electrical resistance on the side of the object to be charged. Further, when the object to be charged is an image bearing member (photosensitive member), an electrostatic latent image must be retained for a certain length of time. Therefore, the proper range for the volumetric resistivity of the charge injection layer 16 is $1\times10^9$–$1\times10^{14}$ ($\Omega\cdot$cm).

It should be noted here that even if a photosensitive member lacks a charge injection layer 16 such as the one described in this embodiment, an effect equivalent to the effect generated by the charge injection layer 16 in this embodiment can be generated if the volumetric resistivity of the charge transfer layer 15, for example, is within the above described range.

Further, an effect similar to the effect described in this embodiment can be obtained by an amorphous silicon based photosensitive member, the surface layer of which has a volumetric resistivity of an approximately $10^{13}$($\Omega\cdot$cm).

Figure 4:
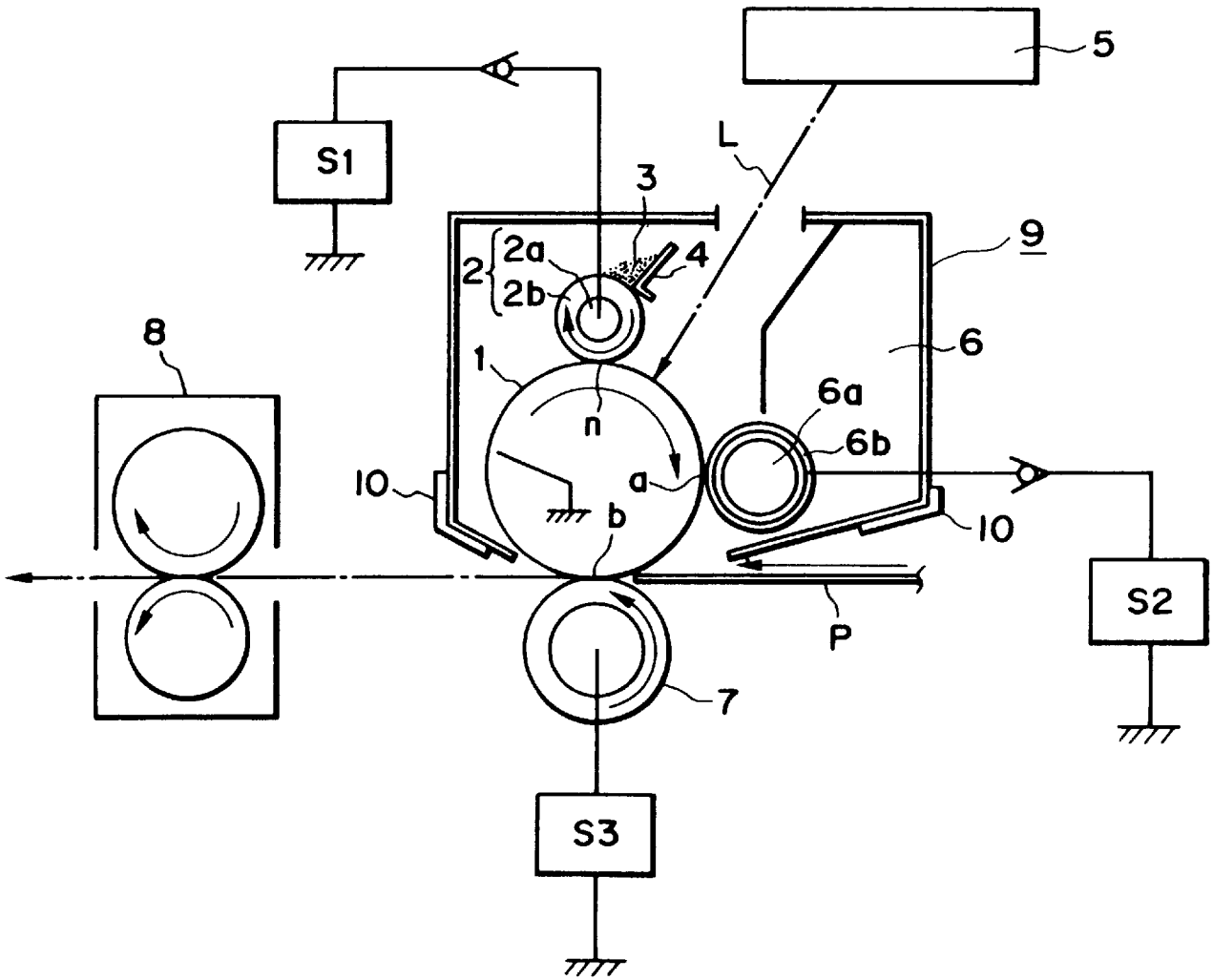
FIG. 4 is a schematic section of the image forming apparatus in the fourth embodiment of the present invention, and depicts the general structure of the apparatus.
Figure 5:
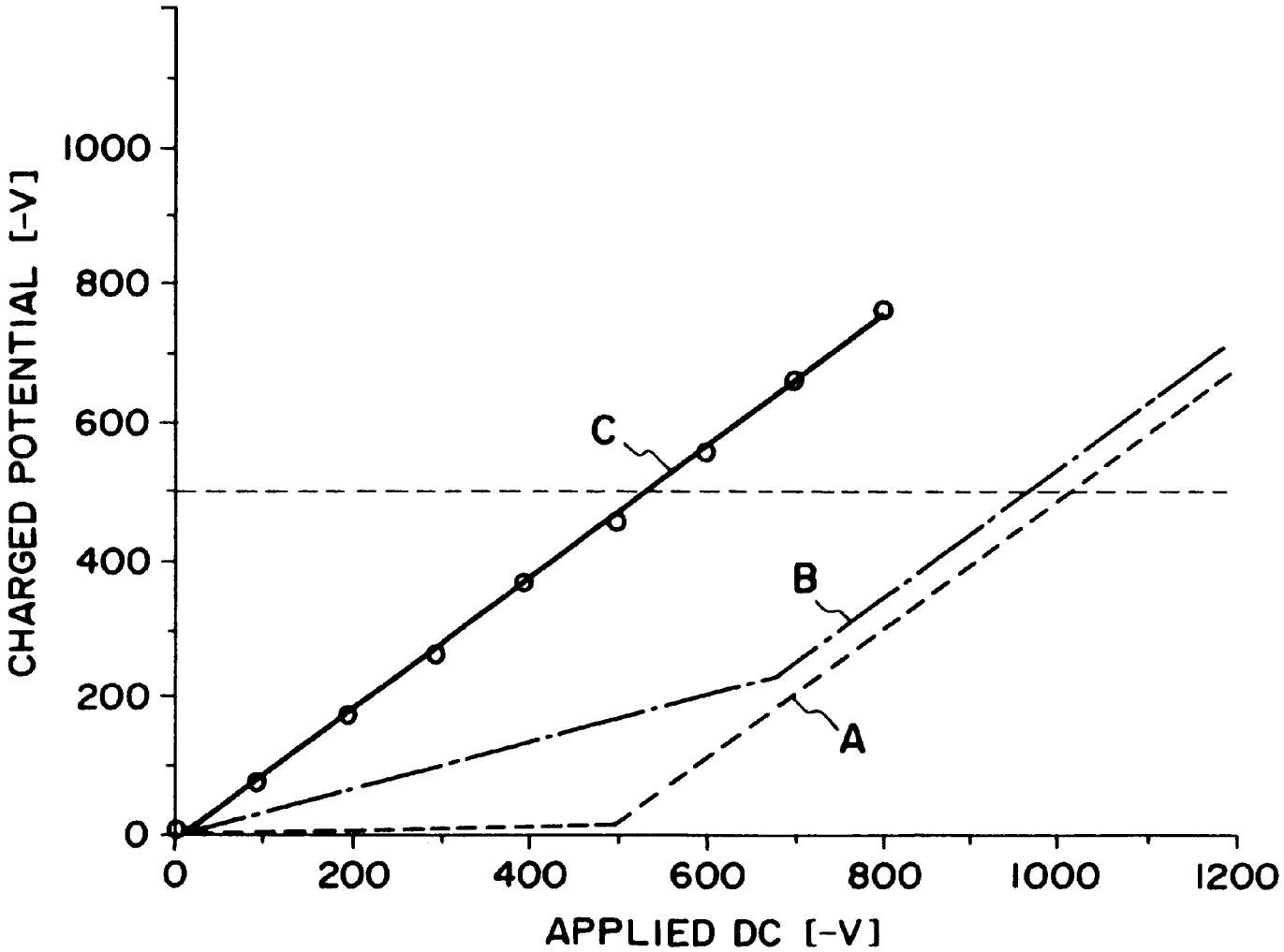
FIG. 5 is a graph which shows the relationship between the voltage applied to a charging member and the potential level reached by a charged object.

Embodiment 4 (FIG. 4)

In this embodiment, an example of an image forming apparatus in accordance with the present invention will be described. FIG. 4 is a schematic section of such an image forming apparatus, and depicts the general structure of the apparatus.

The image forming apparatus in this embodiment is a laser beam printer (recording apparatus) which employs a transfer-type electrophotographic process, a replaceable process cartridge, and a toner recycling process (cleanerless system).

Even though this image forming apparatus is a cleanerless image forming apparatus, that is, an image forming apparatus which does not have a cleaning apparatus, it can directly charge an image bearing member, that is, it can desirably inject charge into the image bearing member, since it employs a contact-type charging member in accordance with the present invention, as a means for charging the image bearing member.

(1) General Structure

Reference numeral FIG. 1 designates an image bearing member, which is an electropnhotographic photosensitive member of a rotational-drum type, with a diameter of 30 mm. It comprises a negatively chargeable organic photoconductor layer, and is rotatively driven in the clockwise direction indicated by an arrow mark at a predetermined peripheral velocity (process speed PS), which is 50 mm/sec or 100 mm/sec in this embodiment.

Reference numeral 2 designates a charge roller as a contact-type charging member for charging the photosensitive member 1. The contact-type charging apparatus in this embodiment is the same as the one described in the second embodiment. In other words, the charge facilitator particle supplying means 4 is disposed on the side of the charge roller 2. This charge roller 2 is rotatively driven in the clockwise direction indicated by an arrow mark, so that the peripheral surfaces of the charge roller 2 and the photosensitive member 1 move in the opposite directions in the charging nip n. In other words, the charge roller 2 and the photosensitive member 1 are driven so that there exists a peripheral velocity difference between the surface of the charge roller 2, and the surface of the photosensitive member 1. To the metallic core 2*a* of the charge roller 2, −700 V of DC voltage is applied from a charge bias application power source S1.

Thus, just as described in the second embodiment, the charge facilitator particles 3 are coated on the peripheral surface of the charge roller 2 by the charge facilitator particle supplying means 4, and are carried to the charging nip n by the charge roller 2, being thereby constantly present between the peripheral surfaces of the photosensitive member 1 and the charge roller 2 which are moving in the opposite direction, creating a difference in peripheral velocity between the two peripheral surfaces. Therefore, the photosensitive member 1 is charged by the charge roller 2 dominantly through the direct charging mechanism (charge injection). Consequently, the photosensitive member 1 is uniformly charged to a potential level substantially equal to the voltage level of the charge bias applied to the charge roller 2.

Designated by a reference numeral 5 is a laser beam scanner (exposing device) which comprises a laser diode, a polygon mirror, and the like. This laser beam scanner outputs a scanning beam of laser light L, the intensity of which is modulated with serial digital electric signals generated by digitizing the optical information of a target image, and which scans, or exposes, the uniformly charged peripheral surface of the photosensitive member 1. As a result, an electrostatic latent image corresponding to the optical information of the target image is formed on the peripheral surface of the cylindrical photosensitive member 1.

Reference numeral 6 designates a developing apparatus. The electrostatic latent image on the peripheral surface of the cylindrical photosensitive member 1 is developed into a toner image by this developing apparatus. This developing apparatus 6 is a noncontact-reversal type apparatus which employs, as a developer carrier member, a nonmagnetic development sleeve 6*b* which encases a magnetic roller 6*a*. It is usable with either a single component developer or a two component developer. A location designated by a reference character a, that is, a location at which the peripheral surface of the photosensitive member 1 and the peripheral surface of the development sleeve 6*b* are closest to each other, is a development station. S2 designates a power source from which development bias is applied to the development sleeve 6*b*.

Reference numeral 7 is a transfer roller, which forms a transfer nip b at a point at which it is pressed against the peripheral surface of the photosensitive member 1, with a predetermined pressure. Into this transfer nip b, a sheet of recording medium, or a transfer sheet P, which is delivered from an unillustrated sheet feeder portion, is fed while a transfer bias with a predetermined voltage level is being applied to the transfer roller 7 from the power source S3. As a result, the toner image on the photosensitive member 1 side is transferred, sequentially from one end to the other, onto the surface of the transfer sheet P fed into the transfer nip b.

Reference numeral 8 is a fixing apparatus. After being fed into the transfer nip b and receiving the toner image transferred from the photosensitive member 1 side, the transfer sheet P is separated from the peripheral surface of the cylindrical photosensitive member 1, and then is guided into the fixing apparatus 8, in which the toner image is permanently fixed to the transfer sheet P to complete a print or copy.

The printer in this embodiment is of a cleanerless type. Thus, the residual toner, or the toner which remains on the peripheral surface of the cylindrical photosensitive member 1 after a toner image is transferred onto a transfer sheet P, is not removed by a cleaner, but instead, is carried to the location of the charge roller 2, or the charging nip. In the charging nip, the peripheral surface of the photosensitive member 1, on which the residual toner is present, is charged. Then, as the photosensitive member 1 is further rotated, a latent image is formed on the peripheral surface of the photosensitive member 1, which is still carrying the residual toner after being charged. As the photosensitive member 1 is further rotated, the residual toner is carried to the development station a, in which the residual toner is removed (recovered) by the developing apparatus at the same time as the electrostatic latent image is developed. In other words, at the same time as a cleaning electric field, which transfers the residual toner from the dark areas of the photosensitive member 1 to the development sleeve 6*b*, is formed, an electric field, which adheres the toner from the development sleeve 6*b* to the light areas of the photosensitive member 1, is formed.

Reference numeral 9 designates a process cartridge which is replaceable installable in the main assembly of a printer. The printer in this embodiment comprises a photosensitive member 1 and three processing devices: a photosensitive member 1, a charge roller 2 inclusive of a charge facilitator particle supplying means 4, and a development apparatus 6. The photosensitive member 1 and three devices are integrally disposed in a cartridge removably installable in the main assembly of a printer. The combination of the processing devices disposed in the process cartridge is not limited to the above described one, as long as a photosensitive member 1 and at least one processing device are included. Referential numerals 10 and 10 designate guides which guide a process cartridge when the process cartridge is installed or removed, and which hold the process cartridge after the installation.

The charge facilitator particles 3 are desired to be colorless and transparent, or virtually colorless and transparent, particles so that they do not become an obstruction when they are used to facilitate the process in which a photosensitive member 1 is exposed to form a latent image. This is rather important in consideration of the fact that the charge facilitator particles 3 might transfer from the photosensitive member 1 onto a recording sheet P. Further, in order to prevent an exposure beam from being scattered by the charge facilitator particles while the photosensitive member 1 is exposed, the sizes of the charge facilitator particles should be smaller than the picture element size.

In the transfer nip b, the toner image on the photosensitive member 1 is affected, that is, attracted toward the transfer sheet P, by the transfer bias, and aggressively transfers onto a transfer sheet P, but the charge facilitator particles 3 on the photosensitive member 1 do not aggressively transfer onto the transfer sheet P, and remain on the peripheral surface of the photosensitive member 1, being practically adhered thereto, since they are electrically conductive. Moreover, the presence of the charge facilitator particles 3, which are remaining on the peripheral surface of the photosensitive member 1, being practically adhered thereto, is effective to improve the efficiency with which the toner image is transferred from the photosensitive member 1 side to the transfer sheet P side.

(2) Comparison Between the Present Invention and Prior Technology

The superior test results of the present invention are summarized in Table 1, along with the results of a comparative technology.

TABLE 1

| | Structure | Ghost evaluation PS = 50 mm/sec | Ghost evaluation PS = 100 mm/sec |
|---|---|---|---|
| Comparison | no particle supply | NG | NG |
| Embodiment 1 | particle on photosensitive member 1 | G | F |
| Embodiment 2 | particles on charge roller 2 | G | F |
| Embodiment 3 | resistance adjustment for outermost layer of photosensitive member | G | G |
| Embodiment 4 | cleanerless, particles on charge roller 2 | F | F |

In the comparative sample, a printer identical to the printer illustrated in FIG. 4 is used, and the surface of the charge roller 2 is coated with the charge facilitator particles 3 in advance, but is not supplied with additional charge facilitator particles 3 during an image forming operation.

The evaluation of the charging performance was made in terms of the ghosts in the finished copies, which were produced using two different printing speeds (process speed PS): 50 mm/sec and 100 mm/sec. There are two types of ghosts: exposure ghosts and transfer residual ghosts. The exposure ghost is an unwanted image which is created on the transfer sheet P when the performance of the charging apparatus is insufficient. More specifically, if the performance of the charging apparatus is insufficient, the areas of the photosensitive member 1 corresponding to the latent image formed during the preceding rotation of the photosensitive member 1 are insufficiently charged during the following rotation of the photosensitive member 1, being thereby developed into an unwanted toner image, or a ghost image. The residual toner ghost, created as the residual toner, which remains on the photosensitive member 1, prevents the photosensitive member 1 from being sufficiently charged. It is liable to occur when an image forming apparatus is of a cleanerless type, since a cleanerless apparatus is more liable to leave the residual toner on the photosensitive member 1. In this test, both ghosts were evaluated together, based on the following criteria.

NG: Ghost pattern is visible in the white areas.

F: Ghost pattern is not visible in the white areas, but visible in the areas with intermediary tint.

G: No ghost pattern is visible either in the white areas, or the areas with intermediary tint.

Further, evaluation of the ghosts was made after printing 100 copies by feeding sheets of A4 size, with the longer edge being placed in perpendicular to the sheet feeding direction.

In the cases of embodiments 1 and 2, in which the charge facilitator particles 3 were supplied to the charging nip n by coating them on the photosensitive member 1 and charge roller 2, respectively, substantially satisfactory charging performance was realized at both speeds.

In addition, when the electrical resistance of the surface layer of the photosensitive member 1 was adjusted as described in the third embodiment, the charging performance was so improved that the photosensitive member 1 was sufficiently charged even at a printing speed of 100 mm/sec.

Further, even in the case of a cleanerless apparatus such as the one described in the fourth embodiment, substantially satisfactory charging performance was realized at both speeds.

Further, in any of the above described cases, images did not have a flowing appearance. As for the flowing appearance, it is liable to occur under the condition of high temperature-high humidity, in the following manner. As ozonic products and the like adhere to the peripheral surface of the photosensitive member 1, the electrical resistance of the surface layer of the photosensitive member 1 is reduced, which causes a latent image to blur, and this blurred latent image produces an image with the flowing appearance as it is developed.

Figure 6:
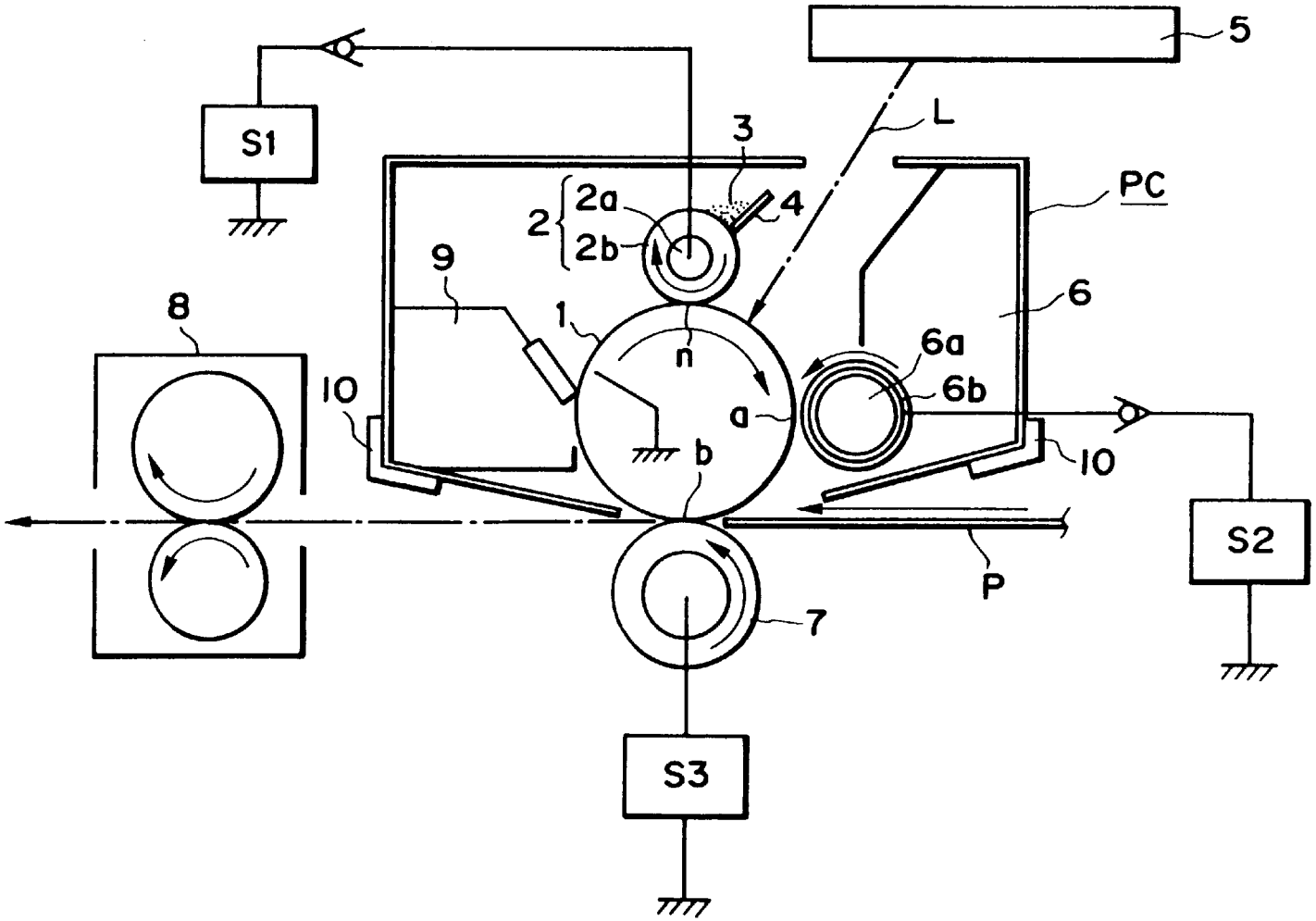
FIG. 6 is a schematic section of the image forming apparatus in the fifth embodiment of the present invention, and depicts the general structure of the apparatus.
Figure 7:
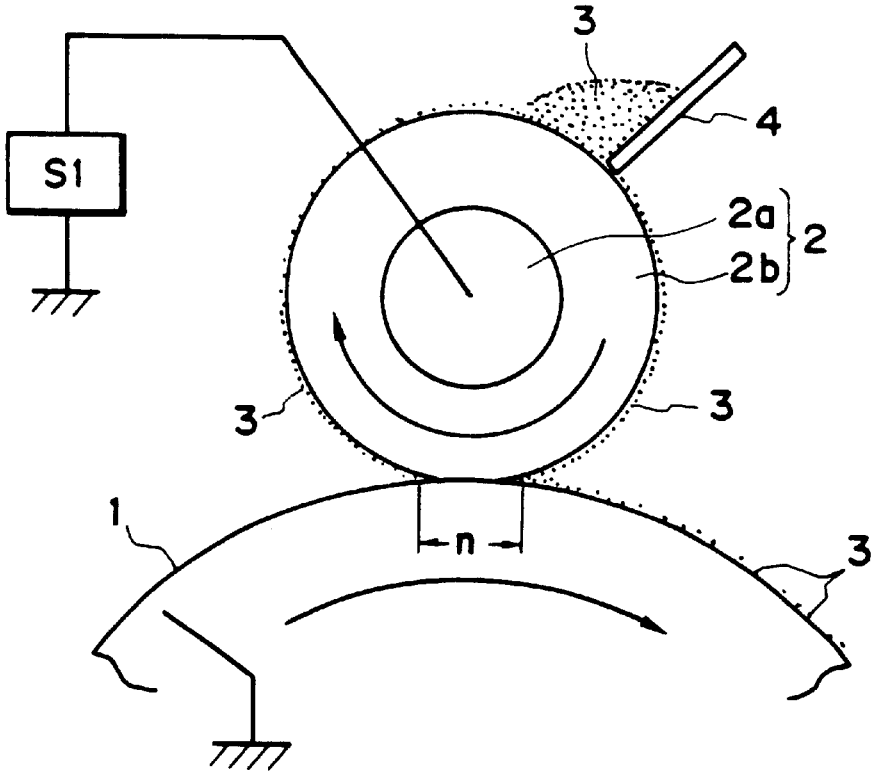
FIG. 7 is an enlarged section of a charge roller and the adjacencies thereof.
Figure 8:
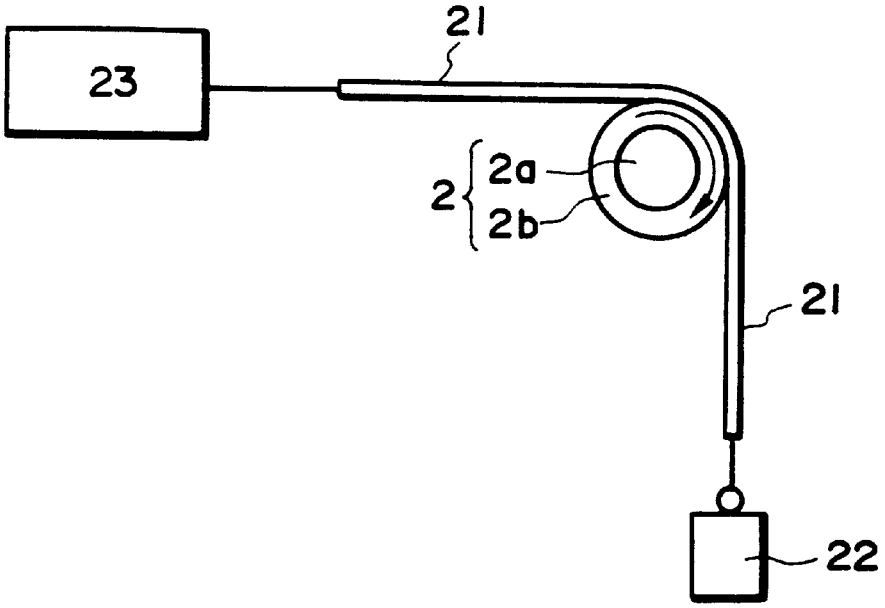
FIG. 8 is a schematic drawing which depicts a method for measuring the coefficient of static friction.

Embodiment 5 (FIGS. 6–8)

Also in this embodiment, an image forming apparatus in accordance with the present invention will be described. In the preceding embodiments, a developing apparatus is caused to double as an apparatus for cleaning a photosensitive member, whereas in this embodiment, a cleaning blade is employed to clean the photosensitive member. FIG. 6 is a schematic section of an image forming apparatus which employs a contact-type charging apparatus in accordance with the present invention.

The image forming apparatus in this embodiment is a laser beam printer (recording apparatus) which employs a transfer-type electrophotographic process, a replaceable process cartridge, and a direct charging mechanism.

(1) General Structure

Reference numeral 1 designates an image bearing member, which is an electrophotographic photosensitive member of a rotational drum type, with a diameter of 30 mm. It comprises a negatively chargeable organic photoconductor layer, and is rotatively driven in the clockwise direction indicated by an arrow mark at a processing speed (peripheral velocity) of 50 mm/sec Reference numeral 2 designates a charge roller as a contact-type charging member for charging the photosensitive member 1. Reference character 4 designates a member which coats the charge roller 2 with particles 3. The charge roller 2, the particles 3, the particle coating member 4, and the principle of direct charging, will be described in detail in paragraph (2).

The charge roller 2 is pressed on the photosensitive member 1, against its own elasticity, forming a nip n (charging nip) which has a width of 5 mm. It is rotatively driven at a revolution of 80 rpm in the clockwise direction indicated by an arrow mark, so that the peripheral surfaces of the charge roller 2 and the photosensitive member 1 move in the opposite directions in the charging nip n. To the charge roller 2, −700 V of DC voltage is applied from a charge bias application power source S1. As a result, the peripheral surface of the photosensitive member 1 is uniformly charged, through the direct charging mechanism, to a potential level of −680 V, which is substantially equal to the voltage level of the charge bias applied to the charge roller 2.

Designated by reference numeral 5 is a laser beam scanner (exposing device) which comprises a laser diode, a polygon mirror, and the like. This laser beam scanner outputs a scanning beam of laser light L, the intensity of which is modulated with serial digital electric signals generated by digitizing the optical information of a target image, and which scans, or exposes, the uniformly charged peripheral surface of the photosensitive member 1. As a result, an electrostatic latent image corresponding to the optical information of the target image is formed on the peripheral surface of the cylindrical photosensitive member 1.

Reference numeral 6 designates a developing apparatus. The electrostatic latent image on the peripheral surface of the cylindrical photosensitive member 1 is developed into a toner image by this developing apparatus. This developing apparatus 6 is a reversal-type apparatus which employs a single component dielectric toner (negative toner). Designated by reference numeral 6*a* is nonmagnetic development sleeve which encases a magnet 6*b*. The diameter of the development sleeve 6*a* is 16 mm. The negative toner is coated on this development sleeve 6*a*. The distance between the peripheral surfaces of the development sleeve 6*a* and the photosensitive member 1 is fixed at 300 $\mu$m. The development sleeve 6*a* is rotated at the same velocity as the photosensitive member 1, and development bias is applied to the development sleeve 6*a* from a development bias application power source S2. Designated by reference character a is a development station, that is, a location at which the peripheral surface of the photosensitive member 1 and the peripheral surface of the development sleeve 6*a* is closest to each other. As for the development bias, a DC voltage of −500 V, and an AC voltage with a frequency of 1,800 Hz, a peak-to-peak voltage of 1,600 Hz, and a rectangular waveform, are superposingly applied to cause the toner to jump from the development sleeve 6*a* to the photosensitive member 1.

Designated by reference numeral 7 is a transfer roller with intermediary electrical resistance. It forms a transfer nip b at a point at which it is pressed against the peripheral surface of the photosensitive member 1, with a predetermined pressure. Into this transfer nip b, a sheet of recording medium, or a transfer sheet P, which is delivered from an unillustrated sheet feeder portion, is fed while a transfer bias with a predetermined voltage level is being applied to the transfer roller 7 from a transfer bias application power source S3. As a result, the toner image on the photosensitive member 1 side is transferred, sequentially from one end to the other, onto the surface of the transfer sheet P fed into the transfer nip b. In this embodiment, the electrical resistance of the transfer roller 7 is $5\times10^8$ Ω, and the toner image is transferred by applying a DC voltage of +2,000 V to the transfer roller, 7. During image transfer, the transfer sheet P is guided into the transfer nip b, and the toner image which has been formed and held on the peripheral surface of the photosensitive member 1 is transferred, sequentially from one end of the image to the other, onto the top side of the transfer sheet P by the electrostatic force and the nip pressure, while the transfer sheet P is conveyed through the transfer nip b, being pinched by the transfer roller 7 and the photosensitive member 1.

Designated by reference numeral 8 is a fixing apparatus. After being fed into the transfer nip b and receiving the toner image transferred from the photosensitive member 1 side, the transfer sheet P is separated from the peripheral surface of the cylindrical photosensitive member 1, and then is guided into the fixing apparatus 8, in which the toner image is permanently fixed to the transfer sheet P. Thereafter, the transfer sheet P is discharged from the apparatus as a print or a copy.

A reference numeral 9 designates a cleaning apparatus (cleaner). After a toner image is transferred onto a transfer sheet P, the peripheral surface of the photosensitive member is cleaned by this cleaning apparatus; the contaminants such as the residual toner on the peripheral surface of the photosensitive member are removed by the cleaning blade of the cleaning apparatus. Then, the surface is used for the following image formation cycle.

The printer in this embodiment is a cartridge type apparatus. As for a cartridge employed in this printer, a photosensitive member 1, and four processing devices: a charge roller 2 inclusive of particles 3 and a particle coating member 4, a developing apparatus 6, and a cleaning apparatus, are integrally disposed in a cartridge so that they can be installed into, or removed from, the printer all at once. The combination of the processing devices disposed in a cartridge is not limited to the above described one; it is optional. Reference numerals 10 and 10 designate members which guide and hold a process cartridge PC. The type of an image forming apparatus compatible with the present invention is not limited to the cartridge type.

(2) Charge Roller 2, Particles 3, and Particle Coating Member 4

FIGS. 7 and 8 are enlarged schematic sections of the charge roller 2 and the adjacencies thereof in the printer. In the case of the contact type charging apparatus in this embodiment, the coefficient of friction between the photosensitive member 1 and the charge roller 2 is reduced by coating particles 3 on a charge roller 2 composed of elastic material, so that the charge roller makes uniform contact with the peripheral surface of the photosensitive member 1.

a) Charge Roller 2

The charge roller 2 in this embodiment is constituted of a roller composed of foamed elastic material, that is, EPDM in which carbon particles are dispersed to adjust electrical resistance. More specifically, it comprises a metallic core 2*a* with a diameter of 6 mm; and an elastic layer 2*b* formed by coating the peripheral surface of the metallic core 2*a* with the aforementioned foamed elastic material, to a thickness of 3 mm. It is 12 mm in external diameter, and 250 mm in length.

The hardness of the charge roller 2 is 30 in ASKER-C scale. The peripheral surface of the charge roller 2 is constituted of the polished bare surface of the foamed material.

The peripheral surface of this charge roller 2 is placed in contact with the peripheral surface of the photosensitive member 1, with a contact pressure generated by applying a spring load of 500 g to each longitudinal end of the charge roller 2, forming a nip with a width of 5 mm.

With this arrangement, the peripheral surface of the charge roller 2 makes uniform contact with the peripheral surface of the photosensitive member 1 at a microscopic level. As a result, desirable charge injection is possible.

To the metallic core 2*a* of the charge roller 2, a DC voltage of −700 V is applied as charge bias from a charge bias application power source S1 as described before.

Regarding the charging mechanism, a solid roller in accordance with the technologies prior to the present invention is not desirable as a part of the charging mechanism for the image forming apparatus in this embodiment, since the hardness of such a roller is too high (63 in ASKER-C scale) to form a nip wide enough to afford sufficient time for charge injection. Further, in the case of a contact-type charging mechanism based on the technologies prior to the present invention, which primarily relies on electrical discharge, the peripheral surface of a photosensitive member is charged by causing electrical discharge in the gap at each of the front and rear edges of the contact nip, and therefore, there is no problem even if a solid charge roller is used. However, in the case of the contact-type charging mechanism in this embodiment, if a solid charge roller is used for charge injection, problems such as the lack of charging time, the nonuniformity of charge, and the like occur.

The electrical resistance of the charge roller 2 in this embodiment is $1\times10^6$ Ω when 100 V is applied (it is converted from the value of the current which flowed when 100 V was applied to the charge roller 2 pressed against a metallic drum with a diameter of 30 mm, forming a nip with a width of 5 mm). It is desirable that the electrical resistance of the charge roller 2 is no less than $10^4$ Ω, and no more than $10^7$ Ω. This is due to the following reason. That is, if defects such as pin holes develop in the photosensitive member 1, excessive current flows through these defective spots, causing the photosensitive member 1 to be insufficiently charged in the charging nip n, and in order to prevent the occurrence of such excessive current flow, the electrical resistance of the charge roller 2 should to be no less than $10^4$ Ω, whereas in order for a sufficient amount of charge to be injected into the surface layer of the photosensitive member 1, the electrical resistance of the charge roller 2 should be no more than $10^7$ Ω.

As for the hardness of the charge roller 2, if it is extremely low, the shape of the charge roller 2 becomes unstable, making unstable the state of contact between the charge roller 2 and the photosensitive member 1, whereas if the hardness of the charge roller 2 is extremely high, not only does it become difficult to create a charge nip of a proper size, but also, the state of contact between the charge roller 2 and the photosensitive member 1 becomes inferior in terms of microscopic level. Thus, the desirable range for the hardness of the charge roller 2 is 25 to 50 in ASKER-C scale.

The material for the charge roller 2 is not limited to foamed elastic material. For example, in addition to the aforementioned material, compound elastic material composed of elastic material such as EPDM, urethane, NBR, silicon rubber, or IR, and electrically conductive material such as carbon black or metallic oxide dispersed in the elastic material to. adjust electrical resistance, is also usable. The electrical resistance may be adjusted with the use of ion conductive material, instead of dispersing electrically conductive material.

In this embodiment, the photosensitive member 1 is charged through a direct charge injection process without using electrical discharge, and therefore, the state of contact between the charge roller 2 and the photosensitive member 1 must be rendered optimum, that is, the gaps between the charge roller 2 and the. photosensitive member 1 must be eliminated as much as possible. In order to realize such a condition, the charge roller 2 is rotated at a revolution of 80 rpm, in such a direction that in the contact nip, the peripheral surface of the charge roller 2 moves in the direction opposite to the moving direction of the photosensitive member 1 (counter rotation). The number of revolutions is not limited to 80 rpm. In other words, the optimum number of revolutions for the charge roller 2 changes if such factors as the size of the charging nip n between the charge roller 2 and the photosensitive member 1, process speed (peripheral velocity of the photosensitive member 1), and the like, are changed.

b) Particles 3

In this embodiment, particles 3 are used to produce a lubricative effect (friction reducing effect) which reduces the friction between the charge roller 2 as a contact-type charging apparatus and the photosensitive member 1 as an object to be charged, and a charging facilitating effect. Hereinafter, the particles 3 will be referred to as "charge facilitator particles". The charge facilitator particles 3 are desired to meet the following description in terms of the material, particle diameter, characteristics, and the like, pertinent to charge facilitating faculty.

In this embodiment, electrically conductive zinc oxide particles are used as the charge facilitator particles, which have a specific resistivity of $10^6$ Ω·cm, and an average particle diameter, inclusive of secondary granules, of 3 μm.

The charge facilitator particles 3 do not need to be constituted of particles formed of zinc oxide. For example, they may be constituted of particles formed of electrically conductive nonorganic material other than zinc oxide, or particles formed of a mixture of such material and organic material.

If the electrical resistance of the charge facilitator particle 3 is rendered extremely high, it interferes with the charging injecting faculty of the charge roller 2, and therefore, causes the photosensitive member 1 to be insufficiently charged. Therefore, it is desired to be no more than $10^{12}$ Ω·cm, preferably, no more than $10^{10}$ Ω·m, most desirably, no more than $10^8$ Ω·cm.

The specific resistance of the charge facilitator particle 3 is obtained using a tableting method. That is, first, a cylinder which measures 2.26 $cm^2$ in bottom area size is prepared. Then, 0.5 g of a material sample is placed in the cylinder, between the top and bottom electrodes, and the resistance of the material is measured by applying 100 V between the top and bottom electrode while compacting the material between the top and bottom electrode with a pressure of 15 kg. Thereafter, the specific resistivity of the sample material is calculated from the results of the measurement through normalization.

In order to uniformly charge an object, the average diameter of the charge facilitator particles 3 is desired to be no more than 50 μm. However, 10 nm is the bottom limit, in consideration of the stability of the charge facilitator particles 3.

When the charge facilitator particle 3 is in the form of a granule, the diameter of the granule is defined as the average diameter of charge facilitator granules.

The diameter of the charge facilitator granules is determined based on the following method. First, 100 or more granules are picked with the use of an optical or electron microscope, and their maximum chord lengths in the horizontal direction are measured. Then, volumetric particle distribution is calculated from the result of the measurement. Based on this distribution, 50% average granule diameter is calculated to be used as the average granule diameter of the charge facilitator granules.

As described above, the charge facilitator particles 3 are in the primary state, that is, a powdery state, as well as in the secondary state, that is, a granular state. Neither state creates a problem. Whether the charge facilitator is in the powdery state or in the granular state, the state of the charge facilitator does not matter as long as it can function as the charge facilitator.

c) Particle Coating Member 4

In this embodiment, in order to place the charge facilitator particle 3 in the charging nip n that is, the contact nip between the photosensitive member 1 as an object to be charged, and the charge roller 2 as a contact-type charging member, a means 4 for supplying the surface of the charge roller 2 with the charge facilitator particles 3 is employed. The charge facilitator particle supplying means 4 in this embodiment is constituted of a regulator blade. This regulator blade 4 is placed in contact with the charge roller 2 so that the charge facilitator particles 3 are held in the space formed by the peripheral surface of the charge roller 2 and the regulator blade 4, and at the same time, the charge facilitator particles 3 held in this space are coated on the peripheral surface of the charge roller 2.

More specifically, as the charge roller 2 is rotated, the charge facilitator particles 3 are coated on the peripheral surface of the charge roller 2 at a predetermined ratio, and carried to the charging nip n. In other words, as the charge roller 2 is rotated, the charging nip n is supplied with the charge facilitator particles 3 at a predetermined constant ratio. Thus, a predetermined amount of the charge. facilitator particles 3 is always in the charging nip n.

d) Charging of Photosensitive Member 1

Thus, in this embodiment, the photosensitive member 1 is charged through a contact type charging process, under such a condition that the charge facilitator particles 3 coated on the peripheral surface on the charge roller 2 are present in the charging nip n, that is, the contact nip between the photosensitive member 1 as an object to be charged, and the charge roller 2 as a contact type charging member.

The presence of the charge facilitator particles 3 in the charging nip n, that is, the interface between the charge roller 2 and photosensitive member 1, produces desirable effects as follows: the mechanical friction between the peripheral surface of the charge roller 2 and the peripheral surface of the photosensitive member 1, at the interface between the two, is reduced, which in turn reduce the torque necessary to rotate the charge roller 2, and therefore, the charge roller 2 can be kept in contact with the photosensitive member 1 while being allowed to maintain a predetermined peripheral velocity difference between itself and the photosensitive member 1; and at the same time, the state of the contact between the charge roller 2 and the photosensitive member 1, in terms of the presence of gaps, is rendered more desirable, since the charge facilitator particles 3 present at the interface between the peripheral surfaces of the charge roller 2 and the photosensitive member 1 fill the gaps between the two surfaces in the contact nip. In other words, the charge facilitator particles 3 present in the charging nip n, that is, the contact nip between the charge roller 2 and the photosensitive member 1, rub the peripheral surface of the photosensitive member 1, leaving thereby no gap between the charge roller 2 and photosensitive member 1. Thus, charge is truly directly injected into the photosensitive member 1; the presence of the charge facilitator particles 3 renders the direct charge mechanism (charge injection) dominant in charging the photosensitive member 1 with the use of the charge roller 2.

Consequently, a high level of charge efficiency, which was impossible to attain prior to the present invention, can be attained; the photosensitive member 1 is charged to a potential level of −680 V which is substantially equal to the DC voltage of −700 V applied to the charge roller 2.

As is evident from the above description, according to this embodiment of the present invention, even if a charge roller with a relatively simple structure is employed as a contact-type charging member, the voltage level of the charge bias applied to the charge roller 2 to charge the photosensitive member 1 to a necessary potential level has only to be equivalent to the necessary potential level for the photosensitive member 1, making it possible to realize a safe and reliable charging mechanism which does not rely on electrical discharge. In other words, it is possible to provide a durable contact-type charging apparatus, which employs, as a contact-type charging member, only a simple charging member, such as a charge roller, and yet is capable of uniformly charging an object, through a direct charging process, or the charge injection, which requires relatively low voltage, and does not generate ozone.

Further, according to the present invention, it is possible to produce image forming apparatuses and process cartridges which are capable of uniformly charging an image bearing member, and which do not create problems traceable to ozone production and/or insufficient charge, are simple in structure, and also are low in cost.

(3) Coefficient of Static Friction

The following table (Table 2) shows the results of a test in which the images produced by the image forming apparatus in accordance with the present invention while varying the friction between the charge roller 2 and the photosensitive member 1 by means of varying the ratio at which the charge facilitator particles 3 are coated on the charge roller 2.

TABLE 2

| Amount | Static friction coefficient | Rotation | Uniformity |
|---|---|---|---|
| 0 (μg/cm²) | 3.7 | non-rotation | — |
| 0.1 | 2.8 | nonuniform rotation | NG |
| 0.5 | 1.7 | rotation | F |
| 1 | 1.3 | uniform rotation | G |
| 10 | 1.2 | uniform rotation | E |

NG: No good
F: Fair
G: Good
E: Excellent

1. When the charge facilitator particles 3 are not coated at all, the friction between the charge roller 2 and the photosensitive member 1 became too great, making it substantially impossible to rotatively drive the charge roller 2 while maintaining the peripheral velocity difference relative to the photosensitive member 1.

2. When the coating ratio is 0.1 $\mu g/cm^2$, the charge roller 2 is rotatable, but not smoothly. Further, the charge facilitator particles 3 are not uniformly coated on the charge roller 2.

3. When the coating ratio is no less than 0.5 $\mu g/cm^2$, the charge roller 2 is substantially smoothly rotatable.

Thus, the charging performance of the charge roller 2 was evaluated relative to the coefficient of static friction per 10 mm in the longitudinal direction of the charging nip n between the charge roller 2 and the photosensitive member 1, while varying the ratio at which the charge facilitator particles 3 were coated on the charge roller 2, in a range in which the ratio was no less than 0.5 $\mu g/cm^2$. The results revealed the following: if the coefficient of the static friction was no more than 2.5, the photosensitive member 1 could be moderately uniformly charged; and if the coefficient of the static friction was no more than 1.5, the photosensitive member 1 could be more desirably charged in terms of uniformity.

In the case of the prior charge-roller-based charging mechanism which mainly relies on electrical discharge, a charge roller is rotated by being in contact with a photosensitive member, and therefore, the charge roller does not smoothly rotate unless there is some friction between the charge roller and the photosensitive member. In the case of the charging mechanism in accordance with the present invention, the power which drives the charge roller 2 comes through a medium other than the peripheral surface of the photosensitive member 1, and therefore, even if the friction between the charge roller 2 and the photosensitive member 1 is not as high as it must be in the case of the prior charging mechanism, the charge roller 2 smoothly rotates, rubbing the photosensitive member 1.

However, if the friction between the charge roller 2 and the photosensitive member 1 is extremely small, the state of the contact between the charge roller 2 and the photosensitive member 1 is not satisfactory. In other words, at a macroscopic level, the charge roller 2 is perfectly in contact with the photosensitive member 1, but at a microscopic level, there are many spots in the contact nip where they are not in contact with each other. Therefore, a certain level of static friction is necessary, that is, the coefficient of the static friction between the charge roller 2 and the photosensitive member 1 is desired to be no less than 0.1.

At this point, a method for measuring the aforementioned static friction will be described. Referring to FIG. 8, the peripheral surface of the charge roller 2, which is nonrotatively set, is covered one quarter of the circumference with a piece of 20 mm wide PET (polyethylene terephthalate) tape coated with the same agent as the agent coated on the photosensitive member 1. One end of the tape is attached to a weight 22 which weighs 100 g, the other end is attached to a digital force gauge (product of SHINPO KOGYO, Co., Ltd.). Then, the static frictional force which acts between the charge roller 2 and the photosensitive member 1 is measured with the digital force gauge while the charge roller 2 is rotated at a peripheral velocity of 180 rpm, and the number displayed on the gauge is divided by the weight of the weight 22. Then, the thus obtained value is converted to the value per 10 mm in the width of the charging nip, that is, the coefficient of the static friction between the photosensitive member 1 and the charge roller 2.

Prior to the present invention, contact-type charging apparatuses in which the charge roller 2 and the photosensitive member 1 are different in peripheral velocity have suffered from the following problems: the charge roller 2 does not rotate at all; the surface of the charge roller 2 is shaved when the charge roller 2 rotates; the rotation of the charge. roller 2 is irregular; and the state of the contact between the charge roller 2 and the photosensitive member 1 is not stable. However, in this embodiment, the charge facilitator particles 3 are coated on the peripheral surface of the charge roller 2, and the coated charge facilitator particles 3 reduces the friction between the charge roller 2 and the photosensitive member 1, reducing, thereby, the torque necessary for rotating the charge roller 2. Therefore, the above described problems are eliminated, uniformly charging the photosensitive member 1.

(4) Miscellaneous

The choice for the means for coating the charge roller 2 with the charge facilitator particles 3 does not need to be limited to the means 4 described in this embodiment; it is optional. For example, the means for coating the charge roller 2 with the charge facilitator particles 3 may be such that a piece of foamed material, or a fur brush, in which the charge facilitator particles 3 are impregnated, is placed in contact with the charge roller 2.

Further, a means for coating the peripheral surface of the photosensitive member 1 with the charge facilitator particles 3 may be disposed between the cleaning apparatus 9 and the charge roller 2.

The charge facilitator particles 3 are desired to be colorless and transparent, or virtually colorless and transparent, particles so that they do not become an obstruction when they are used to facilitate the process in which a photosensitive member 1 is exposed to form a latent image. This is rather important in consideration of the fact that the charge facilitator particles 3 might transfer from the photosensitive member 1 onto a recording sheet P. Further, in order to prevent an exposure beam from being scattered by the charge facilitator particles while the photosensitive member 1 is exposed, the sizes of the charge facilitator particles should be smaller than the picture element size.

In the transfer nip b, the toner image on the photosensitive member 1 is affected, that is, attracted toward the transfer sheet P, by the transfer bias, and aggressively transfers onto a transfer sheet P, but the charge facilitator particles 3 on the photosensitive member 1 do not aggressively transfer onto the transfer sheet P, and remain on the peripheral surface of the photosensitive member 1, being practically adhered thereto, since they are electrically conductive. Moreover, the presence of the charge facilitator particles 3, which are remaining on the peripheral surface of the photosensitive member 1, being practically adhered thereto, is effective to improve the efficiency with which the toner image is transferred from the photosensitive member 1 side to the transfer sheet P side.

While the apparatus is in use, the amount of the charge facilitator particles 3 in the charging nip n gradually decreases as the charge facilitator particles 3 are adhered to the photosensitive member 1, and then are scraped away by the cleaning apparatus 9. Thus, the charge facilitator particle coating means 4 is designed to coat the peripheral surface of the charge roller 2 or the photosensitive member 1 with the charge facilitator particles 3 at a constant ratio, so that a predetermined amount of the charge facilitator particles 3 are always in the charging nip n.

A contact-type-charging-apparatus design in which the charge facilitator particle coating means 4 is disposed on the side of the charge roller as a contact-type charging member is effective to reduce the apparatus size, since the charge facilitator particles 3 can be coated without increasing the number of the devices which surround the photosensitive member 1, that is, an object to be charged.

Embodiment 6

This embodiment is the same as embodiment 5, except that the electrical resistance of the surface portion of the object 1 to be charged is adjusted to more uniformly and reliably charge the object 1. More specifically, the peripheral surface of the photosensitive member 1 as an object to be charged is covered with a charge injection layer to adjust the surface resistance of the photosensitive member 1 to $10^{14}$ Ω·cm or less, so that the photosensitive member 1 is more uniformly and reliably charged even at a process speed higher than that in the embodiment 5.

Referring again to FIG. 3 which is an enlarged schematic section of a portion of the photosensitive member 1 provided with the charge injection layer employed in this embodiment, and depicts the laminar structure of the photosensitive member 1, the photosensitive member 1 in this embodiment, which is a negatively chargeable photosensitive member with organic photoconductor, is formed by coating the following first to fifth functional layers, in this order from the bottom, on a base member constituted of an aluminum cylinder (aluminum base) 11 with a diameter of 30 mm.

First layer 12: it is an undercoat layer constituted of an approximately 20 μm thick electrically conductive layer, and is coated to smooth out the defects of the aluminum base 11, and also to prevent the moire caused by the reflection of an exposure laser beam.

Second layer 13: it is a positive charge injection prevention layer, and plays a role in. preventing the positive charge from the aluminum base 11 from canceling the negative charge given to the surface portion of the photosensitive member 1. It is an approximately 1 μm thick layer of Amylan, the electrical resistance of which has been adjusted to approximately $10^6$ Ω·cm (medium resistance) with the use of methoxymethyl nylon.

Third layer 14: it is a charge generation layer constituted of an approximately 3 μm resin layer in which azo pigment has been dispersed. It generates charge couples composed of a negative charge and a positive charge.

Fourth layer 15: it is a charge transfer layer composed of P-type semiconductor created by dispersing hydrazone in polycarbonate resin. Thus, the negative charge given to the surface portion of the photosensitive member 1 is not allowed to transfer through this layer, and only the positive charge generated in the charge generation layer is allowed to transfer to the outermost layer of the photosensitive member 1.

Fifth layer 16: it is a charge injection layer constituted of an approximately 3 μm thick layer composed of compound material created by mixing two parts in weight of photocurable acrylic resin, and five parts in weight of $SnO_2$ particles rendered electrically conductive by being doped with antimony. The average particle diameter of the $SnO_2$ particles is approximately 0.03 μm. In production, the compound material is coated on the photosensitive member 1 by dipping, and is hardened. 16*a* designates a dispersed $SnO_2$ particle (electrically conductive particle, or electrically conductive filler).

The volumetric resistivity of this layer 16 is approximately $10^{13}$ Ω·cm, which does not allow the charge to move in the direction parallel to the peripheral surface of the photosensitive member 1, preventing thereby a final image from being blurred by the horizontal bleeding of the charge at the contour of a latent image, but allowing the charge to move in the thickness direction of the layer 16, minimizing thereby the charge which remains in the layer 16 after image exposure.

With the addition of the charge injection layer 16, the electrical resistance of the surface portion of the photosensitive member. 1 is reduced to $1\times10^{11}$ Ω·cm, whereas with only the charge transfer layer, that is, without the charge injection layer 16, the resistance is $1\times10^{15}$ Ω·cm.

As for the electrical resistance of the charge injection layer 16, as long as it is within a range of $1\times10^{10}$–$1\times10^{14}$ Ω·cm, the photosensitive member 1 can be charged by charge injection, but in consideration of the electrical resistance variation which occurs under detrimental conditions such as the high temperature-high humidity condition, or low temperature-low humidity, it is desired to be in a range of $1\times10^{12}$–$1\times10^{13}$ Ω·m.

The aforementioned photosensitive member 1 with the charge injection layer 16 was installed in the printer described in the fifth embodiment. (FIG. 6). The process speed for the photosensitive member 1 was set at 200 mm/sec, and the number of rotations for the charge roller 2 was set at 320 rpm (peripheral velocity ratio between the photosensitive member 1 and the charge roller 2 was set to be constant). Otherwise, the image forming apparatus in this embodiment was the same as the apparatus described in the fifth embodiment. Then, images were formed using the thus prepared image forming apparatus in this embodiment.

In the case of a photosensitive member prior to the present invention, if the process speed was set relatively high, and the charge nip was left the same as it was for the slower process speed, the photosensitive member sometimes could not be satisfactorily charged through the charge injection process. However, the photosensitive member 1 in this embodiment, which had the aforementioned electrical resistance, could be uniformly charged through the charge injection process in spite of the relatively high process speed.

More specifically, the coefficient of static friction per 10 mm in the longitudinal direction of the charge nip was 0.9. This proves that according to the present invention, even if the process speed is increased, and the number of rotation for the charge roller 2 is also increased (peripheral velocity ratio between the charge roller 2 and photosensitive member 1 is kept constant), the state of contact, in terms of uniformity, between the charge roller 2 and the photosensitive member 1 in the charging station, or the contact nip, remains unchanged, and therefore, the photosensitive member 1 is desirably charged in terms of uniformity.

In this embodiment, a charge injection layer is placed, as the outermost layer, on the photosensitive member 1 with organic photoconductor, so that the photosensitive member 1 is uniformly charged at a relatively high process speed. However, the choice of the photosensitive member structure is not limited to the one described in this embodiment. For example, instead of providing the photosensitive member 1 with the charge injection layer 16, the electrical resistance of the charge transfer layer 15 may be adjusted so that it falls within the aforementioned range. This will provide the same effects as described in this embodiment. Further, employment of an amorphous silicon based photosensitive member, the volumetric resistivity of the surface layer of which is $10^{13}$ Ω·cm, will also give the same effects.

Embodiment 7

In this embodiment, the charge roller 2 is put through a process for reducing the surface friction.

More specifically, the peripheral surface of the charge roller 2 described in the first embodiment is unevenly coated with resin which contains lubricative Teflon (fluorinated resin of Dupont: PTEF), the electrical resistance of which is adjusted with the use of electrically conductive carbon. The uneven coating of the charge roller 2 with the above described resin leaves microscopic irregularities which reduce the surface friction of the charge roller 2 without negatively affecting the state of contact between the charge roller 2 and the photosensitive member 1.

The thus processed charge roller 2 was installed in the printer described in the first embodiment (FIG. 1). As for the photosensitive member 1, a photosensitive member, the surface electrical resistance of which has been adjusted as described in the second embodiment, was employed. However, the charge facilitator particles were not coated. Otherwise, the image forming apparatus in this embodiment was the same as the apparatus described in the first embodiment. Then, the images created by this apparatus were evaluated.

It became evident from the results of the above evaluation that desirable charging performance can be realized by reducing the surface friction of the charge roller 2 with the use of the above described friction reducing process to allow the charge roller 2 to be smoothly rotated while maintaining a predetermined peripheral velocity difference between the charge roller 2 and the photosensitive member 1.

The coefficient of static friction per 100 mm in the longitudinal direction of the charge nip between the charge roller 2 and the photosensitive member 1 was 0.8.

With the employment of the structure described in this embodiment, the charge roller 2 can be smoothly rotated, without the need for providing the charge nip with particles (charge facilitator particles), while maintaining a predetermined peripheral velocity difference, and a desirable state of contact, between the charge roller 2 and the photosensitive member 1. As a result, desirable charging performance is realized.

Miscellaneous

1) Peripheral Velocity Difference Between Charging Member and Object to be Charged Specifically, a charging member is rotatively driven, independently from an object to be charged, to create a predetermined peripheral velocity difference between the charging member and the object. Desirably, the charging member is rotated so that the rotational direction of the charging member in a charging nip becomes opposite to the direction in which the peripheral surface of the object to be charged moves in the charging nip.

It is feasible to create the peripheral velocity difference by moving the peripheral surfaces of both the charging member and the object to be charged, in the same direction in the charging nip. However, the effectiveness of the charge injection is dependent upon the ratio between the peripheral velocities of the charging member and the object to be charged, and in order to create, while moving the two surfaces in the same direction, a peripheral velocity difference equal to the peripheral velocity difference created by moving the two surfaces in the directions opposite to each other, the number of revolutions of the charging roller must be rather drastically increased compared to when the two surfaces are moved in the different direction. Therefore, moving the two surfaces in the opposite directions to each other is advantageous in terms of the number of revolutions of the charging roller. The peripheral velocity difference, here, is defined as follows:

Peripheral velocity difference(%)={(peripheral velocity of charging member −peripheral velocity of object to be charged)/peripheral velocity of object to be charged)}×100

In the above formula, the values of the peripheral velocities of the charging member and the object to be charged are the absolute values of the velocities.

2) Coating Means

The choice of a means for coating charge facilitator particles on an object to be charged or a contact-type charging member does not need to be limited to the means 4 described in the preceding embodiments; it is optional. For example, the means may be such that a piece of foamed member or a fur brush, in which charge facilitator particles are impregnated, is disposed in contact with the object to be charged, or the contact-type charging member.

3) Charge Roller

The choice of the contact-type charging member does not need to be limited to the charge rollers described in the preceding embodiments. In addition to the above described charge rollers, contact-type charging members which are different, in material and/or form, from the above charge rollers, for example, a fur brush, or a piece of felt or the like cloth, may be employed. Further, these materials and forms may be used in various combinations to realize better elasticity and electrical conductivity.

Also, a fur-brush-type charge roller, the peripheral surface of which is covered with pile formed of strands of elastic fiber, may be employed. Such a charge roller is manufactured in the following manner. First, 3 mm long strands of elastic fiber with adjusted electrical resistance (Rec of UNICHIKA, or the like) are piled at a density of 155/mm$^2$, and then, the peripheral surface of a metallic core with a diameter of 6 mm, for example, is covered with the pile.

4) Charge Bias

The charge bias applied to a contact-type charging member or the development bias applied to a development sleeve may be compound voltage composed of DC voltage and an alternating voltage (AC voltage).

The waveform of the alternating voltage is optional; the alternating wave may be in the form of a sine wave, a rectangular wave, a triangular wave, or the like. Also, the alternating current may be constituted of an alternating current in the rectangular form which is generated by periodically turning on and off a DC power source. In other words, the waveform of the alternating voltage applied, as the charge bias, to a charging member or a development member may be optional as long as the voltage value periodically changes.

5) Exposing Means

The choice of the means for exposing the surface of an image bearing member to form an electrostatic latent image does not need to be limited to the laser based digital exposing means described in the preceding embodiments. It may be an ordinary analog exposing means, a light emitting element such as an LED, or a combination of a light emitting element such as a fluorescent light and a liquid crystal shutter. In other words, it does not matter as long as it can form an electrostatic latent image corresponding to the optical information of a target image.

An image bearing member may be constituted of a dielectric member with an electrostatic recording faculty. In the case of such a dielectric member, the surface of the dielectric member is uniformly charged to a predetermined polarity and a predetermined potential level (primary charge), and then, the charge given to the surface of the dielectric member is selectively removed with the use of a charge removing means such as a charge removing needle head or an electron gun to write, or form, the electrostatic latent image of a target image on the surface.

6) Recording Medium

The recording medium onto which a toner image is transferred from an image bearing member may be constituted of an intermediary transfer member such as a transfer drum.

7) Method for Measuring Toner Particle Size

One example of a method for measuring the size of toner particles is as follows. A measuring apparatus is a Coulter counter TA-2 (product of Coulter Co.,Ltd.) To this apparatus, an interface (product of NIPPON KAGAKU SEIKI) through which the values of the average diameter distribution and average volume distribution of the toner particles are outputted, and a personal computer (Canon CX-1), are connected. The electrolytic solution is 1% water solution of NaCl (first class sodium chloride).

In measuring, 0.1–5 ml of surfactant, which is desirably constituted of alkylbenzene sulfonate, is added as dispersant in 100–150 ml of the aforementioned electrolytic solution, and then, 0.5–50 mg of the toner particles are added.

Next, the electrolytic solution in which the toner particles are suspended is processed approximately 1–3 minutes by an ultrasonic dispersing device. Then, the distribution of the toner particles measuring 2–40 $\mu$m in particle size is measured with the use of the aforementioned Coulter counter TA-2, the aperture of which is set at 100 $\mu$m, and the volumetric average distribution of the toner particles is obtained. Finally, the volumetric average particle size of the toner particles is calculated from the thus obtained volumetric average distribution of the toner particles.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a member to be charged; and injection charging means for injecting an electric charge into said member to be charged, said injection charging means including an elastic member for forming a nip with said member to be charged, said elastic member being supplied with a voltage to inject the electric charge into said member to be charged through said nip, wherein electroconductive particles exist in said nip, and a voltage level applied to said elastic member is substantially equal to a charged potential of said member to be charged, wherein said elastic member is movable with a speed difference between itself and said member to be charged.

2. An apparatus according to claim 1, wherein said elastic member is provided on its surface with a rubber layer.

3. An apparatus according to claim 1, wherein said elastic member is a foam member.

4. An apparatus according to claim 1, wherein said elastic member has a resistance of $1\times10^4$ Ω to $1\times10^7$Ω.

5. An apparatus according to claim 1, wherein said apparatus is usable with an electrophotographic image forming apparatus, and said member to charged comprises an organic photosensitive member and a surface layer thereon, said surface layer comprising low resistance particles.

6. An apparatus according to claim 5, wherein a volume resistivity of the surface layer is $1\times10^9$ Ω·cm to $1\times10^{14}$ Ω·cm.

7. An apparatus according to claim 1, wherein the voltage applied to said elastic member is a DC voltage.

8. An image forming apparatus according to claim 1, wherein said elastic member moves in a direction opposite to a direction of movement of said member to be charged.

9. An apparatus according to claim 1, wherein said member to be charged is an image bearing member for bearing an image.

10. An image forming apparatus comprising:

a member to be charged; and charging means for charging said member to be charged, said charging means including an elastic member for forming a nip with said member to be charged, said elastic member being supplied with a voltage, wherein electroconductive particles exist in said nip, wherein said elastic member is movable with a speed difference between itself and said member to charged.

11. An apparatus according to claim 10, wherein said elastic member is provided on its surface with a rubber layer.

12. An apparatus according to claim 10, wherein said elastic member is a foam member.

13. An apparatus according to claim 10, wherein said elastic member has a resistance of $1\times10^4$ Ω to $1\times10^7$ Ω.

14. An apparatus according to claim 10, wherein said apparatus is usable with an electrophotographic image forming apparatus, and said member to charged comprises an organic photosensitive member and a surface layer thereon, said surface layer comprising low resistance particles.

15. An apparatus according to claim 14, wherein a volume resistivity of the surface layer is $1\times10^9$ Ω·cm to $1\times10^{14}$ Ω·cm.

16. An apparatus according to claim 10, wherein the voltage applied to said elastic member is a DC voltage.

17. An image forming apparatus according to claim 10, wherein said elastic member moves in a direction opposite to a direction of movement of said member to be charged.

18. An apparatus according to claim 10, wherein said member to be charged is an image bearing member for bearing an image.

* * * * *

UNITED STATES PATENT AND TRADEMARK OFFICE

CERTIFICATE OF CORRECTION

PATENT NO. : 6,580,889 B1
DATED : June 17, 2003
INVENTOR(S) : Ishiyama et al.

It is certified that error appears in the above-identified patent and that said Letters Patent is hereby corrected as shown below:

Title page,
Item [56], References Cited, FOREIGN PATENT DOCUMENTS,
"JP 6003921 1/1994" should read -- JP 6-003921 1/1994 --.

Column 1,
Line 41, "corona." should read -- corona --.

Column 3,
Line 63, "above described" should read -- above-described --.

Column 4,
Lines 6 and 22, "above described" should read -- above-described --.

Column 6,
Line 32, "powder," should read -- powder --.
Line 40, "corona type" should read -- corona-type --.

Column 10,
Line 33, "distribution a," should read -- distribution, a --.

Column 11,
Line 62, "insufficiently," should read -- insufficiently --.

Column 12,
Line 4, "above mentioned" should read -- above-mentioned --.
Line 67, "particles." should read -- particles --.

Column 13,
Line 63, "nip n" should read -- nip n. --.

Column 14,
Line 47, "by." should read -- by --.
Line 61, "above" should read -- above- --.

Column 17,
Line 6, "above described" should read -- above-described --.
Line 13, "transparent," should read -- transparent --.

UNITED STATES PATENT AND TRADEMARK OFFICE

CERTIFICATE OF CORRECTION

PATENT NO. : 6,580,889 B1
DATED : June 17, 2003
INVENTOR(S) : Ishiyama et al.

It is certified that error appears in the above-identified patent and that said Letters Patent is hereby corrected as shown below:

Column 20,
Line 17, “roller, 7.” should read -- roller 7. --.
Line 50, “above described” should read -- above -described --.

Column 22,
Line 7, “to.” should read -- to --.
Line 16, “the.” should read -- the --.

Column 23,
Line 44, “charge.” should read -- charge --.

Column 26,
Line 3, “charge.” should read -- charge --.
Line 11, “above described” should read -- above-described --.

Column 27,
Line 32, “in.” should read -- in --.

Column 28,
Line 7, “member. 1” should read -- member 1 --.
Line 20, “embodiment.” should read -- embodiment --.

Column 29,
Line 6, “above” should read -- above --.
Line 24, “above described” should read -- above-described --.

Column 30,
Line 19, “above described” should read -- above-described --.

Column 31,
Line 11, “Co.,Ltd.)” should read -- Co., Ltd.). --.

UNITED STATES PATENT AND TRADEMARK OFFICE

CERTIFICATE OF CORRECTION

PATENT NO. : 6,580,889 B1
DATED : June 17, 2003
INVENTOR(S) : Ishiyama et al.

It is certified that error appears in the above-identified patent and that said Letters Patent is hereby corrected as shown below:

Column 32,
Lines 7 and 38, "charged" should read -- be charged --.

Signed and Sealed this

Twenty-fourth Day of May, 2005

JON W. DUDAS
*Director of the United States Patent and Trademark Office*